US010493778B2

(12) United States Patent
Moriya

(10) Patent No.: US 10,493,778 B2
(45) Date of Patent: Dec. 3, 2019

(54) PRINTING APPARATUS

(71) Applicant: SEIKO EPSON CORPORATION, Tokyo (JP)

(72) Inventor: Yuki Moriya, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/055,392

(22) Filed: Aug. 6, 2018

(65) Prior Publication Data

US 2019/0039390 A1 Feb. 7, 2019

(30) Foreign Application Priority Data

Aug. 7, 2017 (JP) ..... 2017-152233

(51) Int. Cl.
*B41J 11/00* (2006.01)
*B41J 15/16* (2006.01)

(52) U.S. Cl.
CPC ..... *B41J 11/002* (2013.01); *B41J 15/16* (2013.01); *B41J 15/165* (2013.01)

(58) Field of Classification Search
CPC ... B41J 11/002; B41J 11/0045; B41J 11/0055; B41J 11/24; B41J 13/02; B41J 13/076; B41J 13/10; B41J 13/106; B41J 15/04; B41J 15/046; B41J 15/16; B41J 15/165
See application file for complete search history.

(56) References Cited

U.S. PATENT DOCUMENTS

2013/0251417 A1* 9/2013 Ishimori ..... G03G 15/2028 399/323
2015/0029279 A1* 1/2015 Sasaki ..... B41J 11/002 347/102
2015/0029280 A1 1/2015 Sasaki
2015/0054895 A1 2/2015 Suzuki et al.

FOREIGN PATENT DOCUMENTS

JP 2015-024604 A 2/2015
JP 2015-024636 A 2/2015
WO WO2014/119031 8/2014

* cited by examiner

*Primary Examiner* — Geoffrey S Mruk
*Assistant Examiner* — Scott A. Richmond
(74) *Attorney, Agent, or Firm* — Workman Nydegger

(57) ABSTRACT

Disclosed is a printing apparatus including a recording head configured to perform printing on a medium that is transported in a transport direction, a guide portion disposed on a downstream side of the recording head in the transport direction and configured to guide the medium, and a first heating unit disposed between the recording head and the guide portion in the transport direction and configured to heat the medium. The guide portion includes a contact member configured to guide the medium by contacting the medium, a coupling portion coupled with the contact member, and a holding unit configured to hold the contact member via the coupling portion. Thermal conductivity of the coupling portion is lower than thermal conductivity of the holding unit.

10 Claims, 21 Drawing Sheets

PRINTING APPARATUS

The present application is based on and claims priority from JP Application Serial Number 2017-152233, filed Aug. 7, 2017, the disclosure of which is hereby incorporated by reference herein in its entirety.

BACKGROUND

1. Technical Field

The present disclosure relates to a printing apparatus.

2. Related Art

For example, a printer (a printing apparatus) is proposed that transports a recording medium (medium) using a roll-to-roll method and performs printing on the medium (WO-A1-2014-119031, for example).

The printing apparatus disclosed in WO-A1-2014-119031 includes a platen (medium support unit) configured to support the medium during the printing, a winding shaft configured to wind the medium after the printing, a tension bar (contact member) that is disposed between the winding shaft and the medium support unit and that is configured to be in contact with the medium and impart tension to the medium, a support arm configured to support the contact member, a support shaft configured to swingably support the support arm, and a spring configured to impart a force to the support arm to make the support arm swing upwards. The printing apparatus suppresses meandering of the medium while the medium is being wound by positioning the center of the support shaft inside the contour of the winding shaft and by aligning the center of the support shaft with the center of the winding shaft as viewed in an axial-direction view of the support shaft.

The tension bar is configured to impart a tension to the medium, and in addition, serves as a guide portion configured to guide the medium so that the medium is wound onto the winding shaft properly. In addition, a heater configured to accelerate drying of the medium is provided between the medium support unit and the contact member. The heater heats the medium after the printing, and thus quickly cures (dries) ink ejected onto the medium to improve printing quality.

In some cases, however, a heated medium may be in contact with the tension bar (guide portion) after the medium is discharged from the portion where the heater is disposed. In such cases, the temperature of the medium falls by being cooled by the tension bar (guide portion). When this happens, drying of the ejected ink on the medium becomes insufficient in cases, for instance, where a large amount of the ejected ink is on the medium and/or where the medium employed does not allow the ink to be dried easily. Insufficiently dried ink is not fixed securely enough, which may result in, for instance, an unintended mixing of colors and/or an unintended change of color tone. In addition, when the drying of the ink is insufficient and a half-dried medium is wound on the winding shaft, a newly-wound half-dried part of the medium may stick to an already-wound part of the medium.

SUMMARY

The disclosure can be realized as the following exemplary embodiments or application examples.

APPLICATION EXAMPLE 1

A printing apparatus according to the Application Example includes a printing unit configured to perform printing on a medium that is transported in a transport direction, a guide portion disposed on a downstream side of the printing unit in the transport direction and configured to guide the medium, and a first heating unit disposed between the printing unit and the guide portion in the transport direction and configured to heat the medium. The guide portion includes a contact member configured to guide the medium by contacting the medium, a coupling portion coupled to the contact member, and a holding unit configured to hold the contact member via the coupling portion. Thermal conductivity of the coupling portion is lower than thermal conductivity of the holding unit.

In the application example, the first heating unit and the guide portion are disposed in this order on the downstream side of the printing unit in the transport direction, and the medium heated by the first heating unit is discharged from the first heating unit and is then guided by the guide portion. In addition, the guide portion includes the contact member configured to guide the medium by contacting the medium, the coupling portion with a low thermal conductivity, and the holding unit configured to hold (support) the contact member via the coupling portion. As the coupling portion with a low thermal conductivity is disposed between the contact member and the holding unit, heat of the contact member is less likely to be conducted to the holding unit. Hence, heat of the medium heated by the first heating unit is less likely to be taken away by the holding unit via the contact member and the coupling portion. Hence, when the heated medium is guided by the guide portion (contact member), the heat of the medium heated by the first heating unit is less likely to be taken away and a high-temperature state of the medium is maintained. That is, after the medium is discharged from the first heating unit, the medium maintains the high temperature.

In a case where, after a discharging of the medium from the first heating unit, the high-temperature state of the medium is maintained, a state where the ink is more easily dried is maintained. Hence, as compared to a case where, after the discharging of the medium from the first heating unit the temperature of the medium falls and drying of the ink is difficult, ink-drying performance after the discharging of the medium from the first heating unit is enhanced. Consequently, even when, for instance, a large amount of ink is ejected onto the medium or a medium employed is less likely to allow the ink to be dried easily, the ink is dried properly and thus the ink is properly fixed on the medium. Thus, such failures that are caused by insufficiently dried ink, ejected onto the medium, due to the temperature fall of the medium having been heated by the first heating unit and then cooled by the guide portion are suppressed.

APPLICATION EXAMPLE 2

In the printing apparatus of the application example described above, the coupling portion may include a first coupling portion coupled to an end portion on a first side of the contact member in a longitudinal direction of the contact member, and a second coupling portion coupled to an end portion on a second side of the contact member in the longitudinal direction of the contact member.

When the coupling portions with a low thermal conductivity are provided in both end portions, in the longitudinal direction, of the contact member, the coupling portions appropriately suppress the temperature fall of the contact member. In addition, as compared to a case where the coupling portion is provided in one end portion, in the longitudinal direction, of the contact member, the holding unit holds more stably the contact member.

APPLICATION EXAMPLE 3

In the printing apparatus of the application example described above, the coupling portion may be provided passing through the contact member from an end portion on a first side of the contact member in a longitudinal direction of the contact member to an end portion on a second side of the contact member in the longitudinal direction of the contact member.

When the coupling portion with a low thermal conductivity is provided passing through the contact member, the coupling portion appropriately suppresses the temperature fall of the contact member. In addition, as the coupling portion makes the contact member more mechanically strong, the contact member becomes thinner, and the contact member has a lower heat capacity. Consequently, even when the medium is in contact with the contact member, the heat of the medium is less likely to be taken away by the contact member.

APPLICATION EXAMPLE 4

In the printing apparatus of the application example described above, the guide portion may include a second heating unit configured to heat the contact member.

Providing the second heating unit configured to heat the contact member allows the thermal energy of the second heating unit to be conducted to the medium by the contact member and thus the medium is heated. That is, when the second heating unit configured to heat the contact member is provided, the medium is heated after the medium is discharged from the first heating unit. Hence, as compared to a case where the medium is not heated, the temperature of the medium becomes higher, resulting in a still higher ink-drying performance after the discharging of the medium from the first heating unit.

APPLICATION EXAMPLE 5

In the printing apparatus of the application example described above, the second heating unit may be disposed at least inside of the contact member.

When the second heating unit is provided inside of (within) the contact member, the guide portion is constructed with a space-saving configuration as compared to a case where the second heating unit is provided outside of (not within) the contact member.

APPLICATION EXAMPLE 6

In the printing apparatus of the application example described above, the contact member may include a contact area in contact with the medium when the contact member guides the medium, and a non-contact area not in contact with the medium when the contact member guides the medium, and the second heating unit may be disposed at least in the non-contact area.

When the second heating unit is disposed in the contact area, the second heating unit creates unnecessary irregularities in the contact area. When the medium is guided (transported) by being in contact with the contact area, the guiding of the medium (transportation of the medium) may be obstructed by such unnecessary irregularities. In this application example, as the second heating unit is disposed in the non-contact area, no unnecessary irregularities are created in the contact area by providing such a second heating unit. Hence, the obstruction that would otherwise be caused by such unnecessary irregularities to the guiding of the medium (transportation of the medium) may be suppressed.

APPLICATION EXAMPLE 7

In the printing apparatus of the application example described above, the contact member may include a contact area in contact with the medium when the contact member guides the medium and a non-contact area not in contact with the medium when the contact member guides the medium. A low-thermal-conductivity member having thermal conductivity that is lower than thermal conductivity of the contact member may be attached to the non-contact area.

The thermal energy of the second heating unit is conducted to the contact member, and the contact member is thus heated. When the medium is guided by being in contact with the contact member, the medium is heated by the contact member. In addition, when the low-thermal-conductivity member is attached to the non-contact area of the contact member, a heat retaining property of the contact member is enhanced, and the contact member heated by the second heating unit maintains the high temperature. When the contact member maintains a high temperature, the medium that is in contact with the contact member also maintains a high temperature. Hence, the ink-drying performance is enhanced further.

In addition, when the low-thermal-conductivity member is attached to the non-contact area, the low-thermal-conductivity member creates no unnecessary irregularities in the contact area. Hence, the obstruction that would otherwise be caused by such unnecessary irregularities to the guiding of the medium (transportation of the medium) may be suppressed.

APPLICATION EXAMPLE 8

In the printing apparatus of the application example described above, the guide portion may include a heat-conduction portion configured to conduct thermal energy generated by the first heating unit to the contact member.

With the heat-conduction portion configured to conduct the thermal energy generated by the first heating unit to the contact member, when the medium is guided by the guide portion (contact member), the thermal energy of the first heating unit is conducted to the medium via the heat-conduction portion and the contact member, and thus the medium is heated. That is, the medium is heated after the medium is discharged from the first heating unit. Hence, as compared to a case where the medium is not heated after the medium is discharged from the first heating unit, the temperature of the medium becomes higher, resulting in a still higher ink-drying performance after the discharging of the medium from the first heating unit.

APPLICATION EXAMPLE 9

The printing apparatus of the application example described above may further include a heated-area support unit configured to support a heated area, which is an area of the medium that is heated by the first heating unit. The heat-conduction portion may include a third coupling portion configured to couple the heated-area support unit to the contact number.

The medium is supported by the heated-area support unit. The thermal energy of the first heating unit is conducted to the medium by the heated-area support unit, and thus the medium is heated. When the heat-conduction portion includes the third coupling portion configured to couple the heated-area support unit with the contact member, the thermal energy of the first heating unit is conducted to the contact member via the heated-area support unit and the third coupling portion, and thus the contact member is heated. In addition, when the medium is guided by the guide portion (contact member), the thermal energy of the first heating unit is conducted to the medium via the heated-area support unit, the third coupling portion, and the contact member. Thus, the medium is heated.

That is, when, the medium is guided by the guide portion (contact member) by providing the third coupling portion configured to couple the heated-area support unit with the contact member, the medium is heated after the medium is discharged from the first heating unit. Hence, as compared to a case where the medium is not heated after the medium is discharged from the first heating unit, the temperature of the medium becomes higher, resulting in a still higher ink-drying performance after the discharging of the medium from the first heating unit.

APPLICATION EXAMPLE 10

In the printing apparatus of the application example described above, the heat-conduction portion may include a circulation unit configured to circulate a fluid between the first heating unit and the contact member.

With the circulation unit configured to conduct the thermal energy generated by the first heating unit to the contact member, when the medium is guided by the guide portion (contact member), the thermal energy of the first heating unit is conducted to the medium via the circulation unit and the contact member, and thus the medium is heated. That is, the medium is heated after the medium is discharged from the first heating unit. Hence, as compared to a case where the medium is not heated after the medium is discharged from the first heating unit, the temperature of the medium becomes higher, resulting in a still higher ink-drying performance after the discharging of the medium from the first heating unit.

BRIEF DESCRIPTION OF THE DRAWINGS

Embodiments of the disclosure will be described with reference to the accompanying drawings, wherein like numbers reference like elements.

DESCRIPTION OF EXEMPLARY EMBODIMENTS

Embodiments of the disclosure are described below with reference to the accompanying drawings. The exemplary embodiments illustrate some aspects of the disclosure, and do not limit the disclosure in any way. The exemplary embodiments can be modified as desired without departing from the scope of the technical concept of the disclosure. For instance, some configurations of the exemplary embodiments described below may be combined appropriately. Further, in each of the drawings below, to make each layer, member, and the like recognizable in terms of size, each of the layers, members, and the like are illustrated to be different to an actual scale.

Exemplary Embodiment 1

Overview of Printing Apparatus

Figure 1:
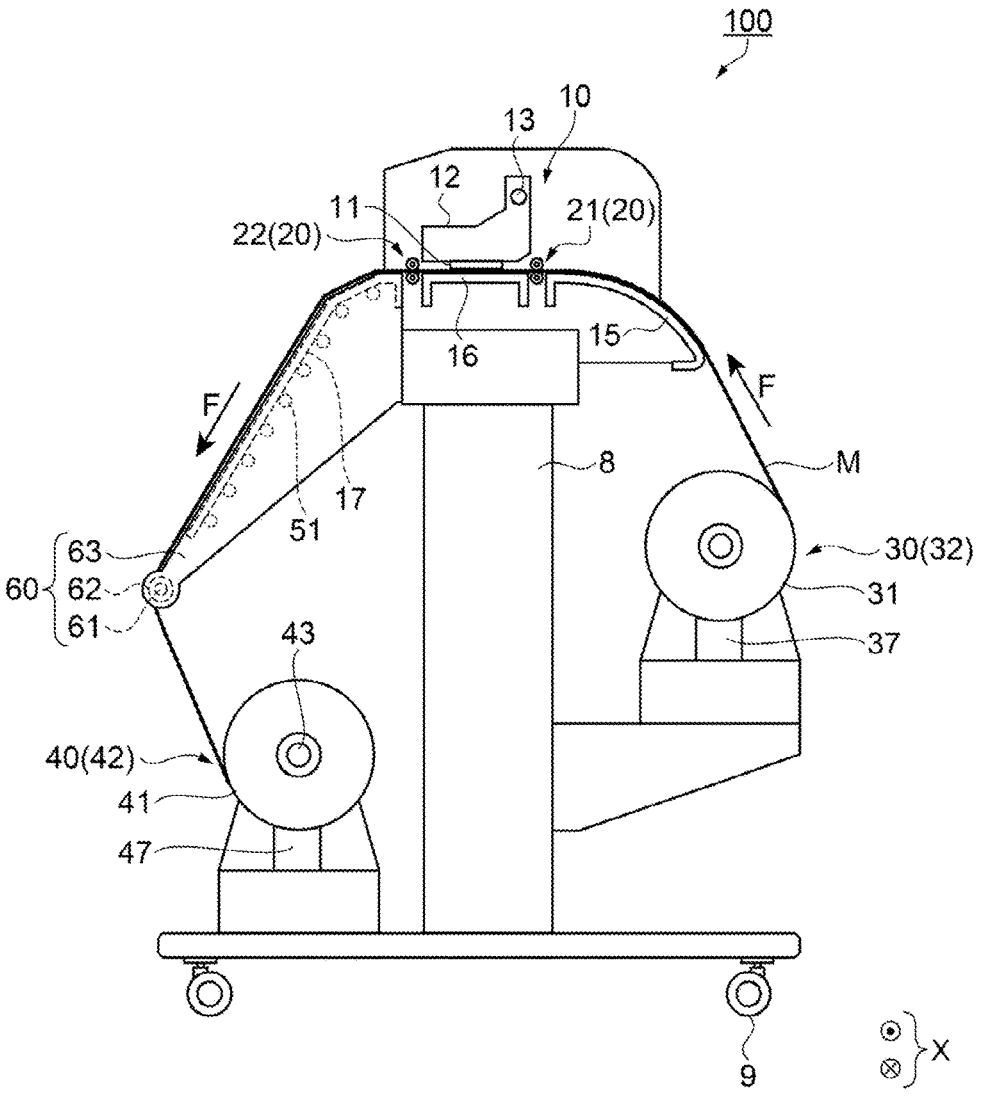
FIG. 1 is a schematic cross-sectional diagram of a printing apparatus according to Exemplary Embodiment 1.

FIG. 1 is a schematic cross-sectional diagram of a printing apparatus according to Exemplary Embodiment 1.

First of all, an overview of a printing apparatus 100 according to Exemplary Embodiment 1 is described with reference to FIG. 1.

As illustrated in FIG. 1, the printing apparatus 100 according to Exemplary Embodiment 1 is a large format printer (LFP) that handles a medium (sheet) M that is long.

The printing apparatus 100 includes a feeding unit 30, a transport unit 20, a recording unit 10 (recording head 11), a guide portion 60, and a winding unit 40, which are disposed in this order along a transport direction F of the medium M.

In other words, the printing apparatus 100 includes the recording unit 10 (recording head 11) configured to perform printing on the medium M that is transported in the transport direction F, and also includes the guide portion 60 disposed on a downstream side of the recording unit 10 (recording head 11) in the transport direction F and configured to guide the medium M.

The medium M is fed out from the feeding unit 30 and passes through a transport roller pair 21 of the transport unit 20. After printing (recording) is performed by the recording unit 10, the medium M passes through a transport roller pair 22 of the transport unit 20 and the guide portion 60, and then is wound by the winding unit 40. Woodfree paper, cast coated paper, art paper, coat paper, synthetic paper, or a film formed of polyethylene terephthalate (PET), polypropylene (PP) or the like can be used as the medium M, for example.

A feeding-side roll body 31 formed of the medium M wound into a roll shape is set in the feeding unit 30. The feeding unit 30 includes a feeding-side support portion 37 and a feeding motor 32. The feeding-side support portion 37 rotatably supports the feeding-side roll body 31. The feeding motor 32 is a driving source that rotates the feeding-side roll body 31. When the feeding motor 32 operates, the feeding-side roll body 31 rotates in a feeding direction, which causes the medium M to be fed out from the feeding-side roll body 31 to the transport roller pair 21.

The transport unit 20 includes the transport roller pair 21 and the transport roller pair 22. The transport roller pair 21 is disposed on an upstream side of the recording unit 10 in the transport direction F, and the transport roller pair 22 is disposed on the downstream side of the recording unit 10 in the transport direction F. In addition, an upstream side support unit 15 is disposed between the feeding unit 30 and the transport roller pair 21. A platen 16 is disposed between the transport roller pair 21 and the transport roller pair 22. A downstream side support unit 17 is disposed between the transport roller pair 22 and the winding unit 40.

The downstream side support unit 17 is an exemplar "heated-area support unit".

The transport roller pair 21 transports the medium M fed out from the feeding-side roll body 31 and supported by the upstream side support unit 15 to the recording unit 10. The transport roller pair 22 transports the medium M printed by the recording unit 10 to the winding unit 40. The medium M transported from transport roller pair 22 is supported by the downstream side support unit 17, guided by the guide portion 60, and wound by the winding unit 40.

The recording unit 10 includes the recording head 11, which is an example of a "printing unit", a carriage 12, a guide shaft 13, and the platen 16. The recording head 11 is an ink jet head provided with a plurality of nozzles that discharge ink. The recording head 11 discharges the ink onto the medium M transported from the transport roller pair 21, and prints an image on the medium M. Specifically, the recording head 11 functions as a printing unit that performs printing on the medium M transported in the transport direction F. The guide shaft 13 extends in a direction (a scanning direction X) intersecting with the transport direction F, and supports the carriage 12. The recording head 11 is mounted on the carriage 12, and a carriage motor (not illustrated) reciprocates the carriage 12 along the guide shaft 13 (in a scanning direction). The platen 16 includes an upper surface that is substantially rectangular and that faces the recording head 11. A longitudinal direction of the upper surface is a width direction of the medium M. The medium M is suctioned and supported on the upper surface of the platen 16 by a negative pressure applied to the platen 16. This configuration suppresses deterioration in printing quality due to lifting of the medium M.

The scanning direction X mentioned above is an example of a "longitudinal direction of a contact member" and corresponds to the width direction of the medium M.

The printing apparatus 100 prints a predetermined image on the medium M by forming dots on the medium M through repetitions of alternating motions of a droplet discharge operation, in which the recording unit 10 discharges the ink as ink droplets from the recording head 11 while moving the recording head 11 in the scanning direction X, and of a transport operation, in which the transport roller pairs 21 and 22 move the medium M in the transport direction F. Specifically, to print the predetermined image, lines of dots (raster lines) are formed each in the scanning direction X by the droplet discharge operation, and the lines of dots (raster lines) are arranged side by side with each other in the transport direction F at equal intervals by the transport operation.

Exemplary Embodiment 1 illustrates, as an example of the recording head 11, a serial-head type recording head, which is mounted on the reciprocating carriage 12 and which discharges the ink while moving in the scanning direction X (width direction of the medium M). The recording head 11, however, may be a line head-type recording head, which extends in the scanning direction X (the width direction of the medium M) and which discharges the ink while the recording head 11 is fixed in place.

The winding unit 40 includes a winding-side support portion 47 and a winding motor 42, and winds the medium M fed out from the recording unit 10 (from the transport roller pair 22) into a roll shape. The winding-side support portion 47 rotatably supports a paper tube (winding core) 43 for winding. A leading end of the medium M is attached to the paper tube 43. The paper tube 43 is rotated by power transmitted from the winding motor 42. Specifically, the winding motor 42 is a driving source that rotates the paper tube 43. When the winding motor 42 rotates in one direction, the paper tube 43 rotates in a winding direction, which causes the medium M to be wound around the paper tube 43. A winding-side roll body 41 is formed of the medium M wound around the paper tube 43.

The guide portion 60 configured to guide the medium M is disposed on the downstream side of the recording unit 10 in the transport direction F (to be more specific, between the downstream side support unit 17 and the winding unit 40). The guide portion 60 is configured to appropriately guide the medium M transported by the transport roller pair 22 in the transport direction F to the winding unit 40. The guide portion 60 is fixedly supported by holding units 63 to a body frame 8. In addition, wheels 9 are attached to a bottom end of the body frame 8. Details of the guide portion 60 will be described later.

A first heating unit 51 configured to heat the medium M is disposed between the recording head 11 and the guide portion 60 in the transport direction F. The first heating unit 51 is, for example, a tube heater, and is attached to the downstream side support unit 17 by aluminum tape or the like. When the first heating unit 51 is driven, heat conducted from the first heating unit 51 heats a surface of the downstream side support unit 17 supporting the medium M. The heat conducted from the downstream side support unit 17 heats the medium M from a backside of the medium M. In other words, thermal energy of the first heating unit 51 is transferred to the medium M via the downstream side support unit 17, and thus heats the medium M.

A temperature of the downstream side support unit 17 heated by the first heating unit 51 is a temperature (e.g., 40 to 50° C.) that is unlikely to adversely affect a user even in a case in which the user touches the downstream side support unit 17. The medium M that is supported by the downstream side support unit 17 is also heated to approximately 40 to 50° C.

The first heating unit 51 is not limited to a tube heater, but may be, for instance, a panel heater. To be more specific, the first heating unit 51 may be a panel heater in which a heating element is laminated with a flexible insulator sheet, or a panel heater in which a heating element is affixed to an aluminum substrate or a non-woven fabric material.

Thus, the first heating unit 51 is configured to heat the medium M via the downstream side support unit 17, to quickly dry the ink discharged from the recording head 11 and landed on the medium M, and to fix the ink on the medium M. Uniformity of the heating temperature achieved by the heating via the first heating unit 51 is likely to affect the fineness of the image. When a heating temperature by the first heating unit 51 is not uniform, bleeding and blurring of the image becomes more likely to take place, which may deteriorate the fineness (quality) of the image printed on the medium M.

The configuration for heating the medium M is not limited to a configuration where the first heating unit 51 is attached to the downstream side support unit 17 and where the medium M is heated from the backside of the medium M by heat conduction. For example, a configuration may also be used where an infrared heater is used as the first heating unit 51, which is disposed to face the surface of the downstream side support unit 17 that supports the medium M, and where the medium M is heated from the front side of the medium M by radiant heat.

In a case where the winding-side roll body 41 is loosely wound on a side closer to the paper tube 43 and is tightly wound on a side farther away from the paper tube 43, when a new medium M is wound around an outer peripheral surface of an already loosely wound roll body, the outer peripheral surface of the already loosely wound roll body is prone to deform as a result of yielding to a force applied by the new medium M wound around the outer peripheral surface, which results in a defect such as wrinkling.

For instance, when the entire medium M is loosely wound or when some part of the medium M is loosely wound, winding displacement is more likely to occur during the winding, which is more likely to cause an irregular wound shape (shape collapse) of the winding-side roll body 41.

To suppress the wrinkling or the irregular wound shape of the medium M on the winding-side roll body 41, the entire medium M may be wound tightly on the winding unit 40 and furthermore, may be wound more tightly (with a stronger force) on the side closer to the paper tube 43.

In Exemplary Embodiment 1, the contact member 61 of the guide portion 60 is in contact with the medium M, and guides the medium M to the winding unit 40 so that the medium M is wound by the winding unit 40 with high accuracy. In addition, when the winding unit 40 winds the medium M in synchronization with the transport operation by the transport roller pair 22, the torque of the winding-side roll body 41 is optimized based on the speed at which the medium M is transported and the inertia (moment of inertia) of the winding unit 40 and thus the tensile strength (tension) of the medium M is adjusted so that the medium M is wound more tightly on the inner side of the winding-side roll body 41 and less tightly on the outer peripheral surface side of the winding-side roll body 41. Moreover, the tensile strength (tension) of the medium M is adjusted so that the entire medium M is wound tightly by the winding unit 40.

Hence a stronger force is applied from the medium M to the guide portion 60 while the guide portion 60 is guiding the medium M. The guide portion 60 is fixedly supported by the body frame 8 to prevent the force applied by the medium M from changing the position of the guide portion 60.

Such a configuration enhances the accuracy with which the winding unit 40 winds the medium M. Furthermore, the medium M is wound by the winding unit 40 with suppressed failures such as wrinkles or irregular wound shapes so that the winding-side roll body 41 is set properly in other apparatuses.

As described above, the first heating unit 51 is configured to heat the medium M via the downstream side support unit 17, to quickly dry the ink that landed on the medium M, and thus fix the ink on the medium M.

When, for instance, the ink that landed on the medium M has not been sufficiently dried and is thus half dried while the medium M is wound by the winding unit 40, a failure may take place as in the winding-side roll body 41, and a part of the medium M that has already been wound may stick to a part of the medium M that is newly wound. In addition, when the ink that landed on the medium M is not sufficiently dried, failures such as the bleeding and/or the blurring of the ink are more likely to take place than in the cases where the ink that landed on the medium M is sufficiently dried. When such failures occur, the fineness of the image printed on the medium M may be degraded.

Therefore, the ink that landed on the medium M may be dried completely while the medium M is being supported by the downstream side support unit 17 heated by the first heating unit 51. However, when the medium M is formed of a material that may retard the drying of the ink and when a relatively large amount of ink is discharged from the recording head 11 onto the medium M, unless the transportation speed of the medium M is slowed down, it is difficult to dry completely the ink that landed on the medium M while the medium M is being supported by the downstream side support unit 17, which may degrade the efficiency (throughput) of the printing apparatus 100.

When the medium M transported from the downstream side support unit 17 towards the winding unit 40 is in contact with and is cooled by the contact member 61, the ink that landed on the medium M becomes harder to dry.

Exemplary Embodiment 1 has a configuration in which even when the medium M transported from the downstream side support unit 17 towards the winding unit 40 is in contact with the contact member 61, the medium M is less likely to be cooled by the contact member 61. That is, the configuration of Exemplary Embodiment 1 is configured to slow the temperature fall of the medium M and thus keep a state where the ink that landed on the medium M is easier to be dried by the remaining heat between the departing of the medium M from the downstream side support unit 17 and the winding of the medium M by the winding unit 40. Such a configuration has excellent effects for suppressing the failures caused by insufficient drying of the medium M (sticking of the medium M in the winding-side roll body 41, bleeding of images, blurring of images, and the like) and for improving the efficiency (throughput) of the printing apparatus 100. The details are described below.

Overview of Guide Portion

Figure 2:
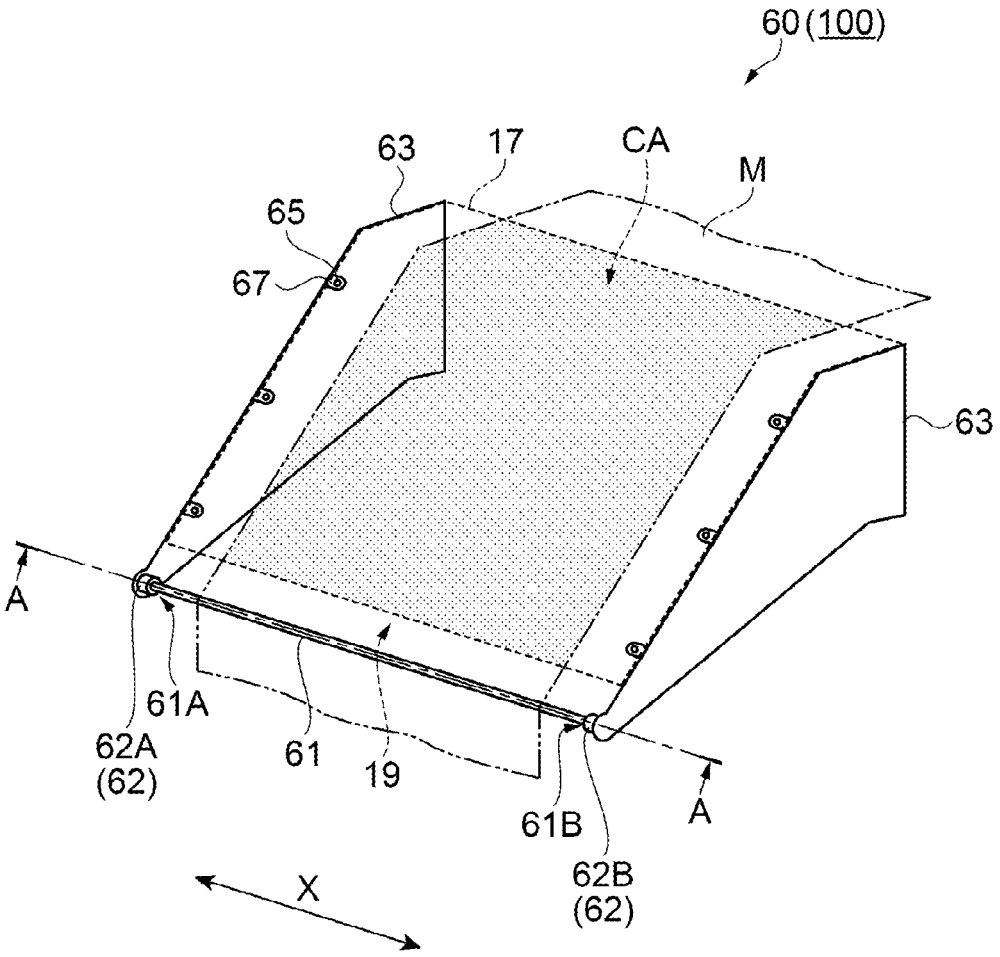
FIG. 2 is a perspective view of a guide portion according to Exemplary Embodiment 1.
Figure 3:
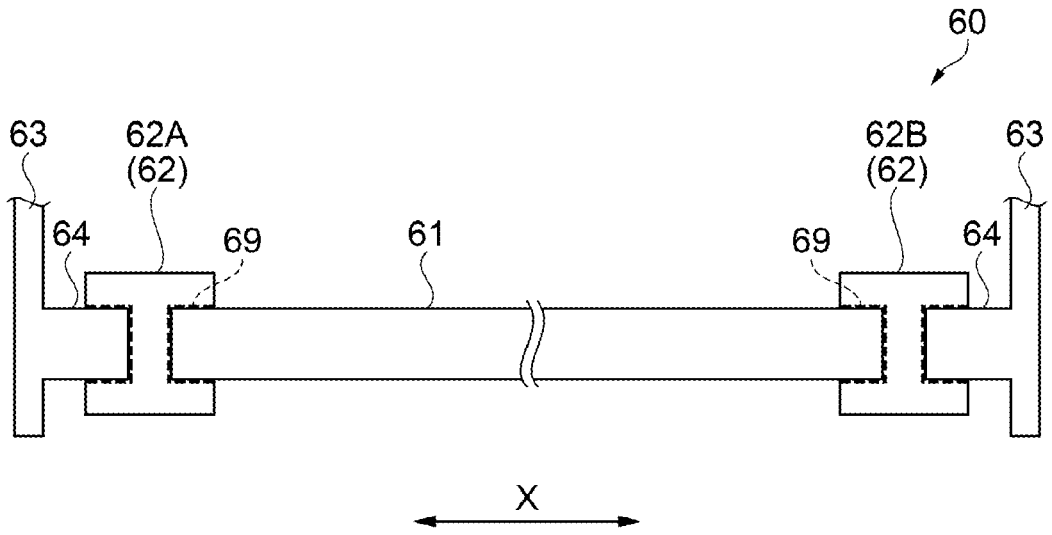
FIG. 3 is a schematic cross-sectional diagram of a guide portion taken along a line A-A of FIG. 2.
Figure 4:
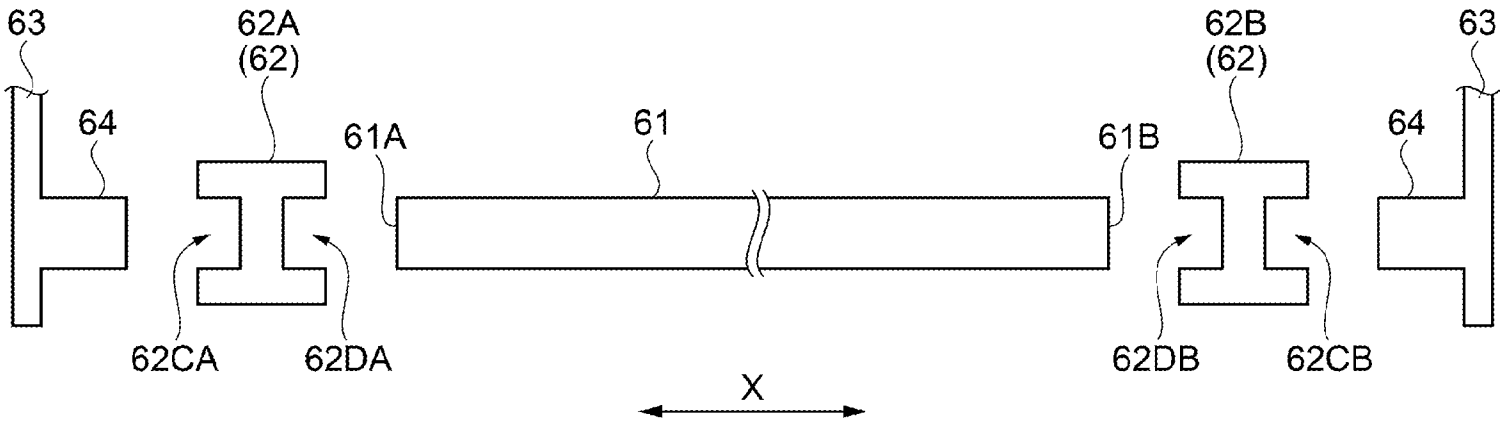
FIG. 4 is an exploded view of a guide portion.

FIG. 2 is a perspective view of the guide portion according to Exemplary Embodiment 1. FIG. 3 is a schematic cross-sectional diagram of the guide portion taken along a line A-A of FIG. 2. FIG. 4 is a diagram corresponding to FIG. 3 and is an exploded view of the guide portion. In FIG. 2, to make the state of the guide portion 60 easier to understand, the downstream side support unit 17 is illustrated by dashed lines and the medium M is illustrated by two-dot chain lines. In addition, FIG. 4 does not illustrate an adhesive 69.

Next, an overview of the guide portion 60 is described with reference to FIG. 2 to FIG. 4.

In FIG. 2, a hatched area CA represents an area where the medium M and the downstream side support unit 17 are in contact with each other, and where the thermal energy of the first heating unit 51 is transferred. Hereinafter, this area CA is referred to as the "contact area CA". That is, the thermal energy of the first heating unit 51 is transferred to the contact area CA of the medium M via the contact area CA of the downstream side support unit 17, and thus the medium M is heated. In other words, the contact area CA of the medium M is an area of the medium M that is heated by the first heating unit 51, and the printing apparatus 100 includes the downstream side support unit 17 configured to support the contact area CA, which is the area of the medium M that is heated by the first heating unit 51.

The contact area CA of the medium M is an exemplar "heated area".

As illustrated in FIG. 2 to FIG. 4, the guide portion 60 includes the contact member 61 configured to be in contact with and thus guide the medium M, the holding units 63 fixedly supported by the body frame 8 (see FIG. 1), and coupling portions 62 each of which is disposed between the contact member 61 and the corresponding holding unit 63. The contact member 61 is supported by the holding units 63 via the coupling portions 62 and is fixed to the body frame 8.

As described above, the guide portion 60 includes the contact member 61 configured to be in contact with and thus guide the medium M, the coupling portions 62 coupled to the contact member 61, and the holding units 63 configured to hold the contact member 61 via the coupling portions 62.

The contact member 61 is formed with the longitudinal direction of the contact member 61 aligned with the intersecting direction (scanning direction X) that intersects the transport direction F. That is, the contact member 61 is a cylindrical-shaped member with its longer side aligned with the scanning direction X, and includes an end portion 61A on a first side in the scanning direction X and an end portion 61B on a second side in the scanning direction X. The contact member 61 is made, for example, from aluminum, and is made lighter in weight by forming an internal cavity. That is, the contact member 61 is a hollow pipe elongated in the scanning direction X. As the contact member 61 is in contact with the medium M, the contact member 61 is heated by the medium M up to a temperature near the temperature of the medium M (approximately 40 to 50° C.)

The holding units 63 are made, for example, from iron and/or stainless steel, and each of the holding units 63 is a plate member processed into a predetermined shape by sheet metal working. When viewed in the scanning direction X, a top end portion of each of the holding units 63 overlaps an end portion of the downstream side support unit 17, and is deformed similarly to the downstream side support unit 17. The holding units 63 are disposed on both sides of the downstream side support unit 17 in the scanning direction X. The holding units 63 include protruding portions 67 that are bent to be in contact with the surface of the downstream side support unit 17 that supports the medium M. The protruding portions 67 of the holding units 63 and the downstream side support unit 17 are fixed (fastened) to each other with head countersunk screws 65. The head countersunk screws 65 are disposed not to stick out of the surfaces of the protruding portions 67 that are opposite the downstream side support unit 17. That is, the head countersunk screws 65 are employed to prevent any irregularities from being formed in the portions where the protruding portions 67 and the downstream side support unit 17 are fastened to each other.

In addition, once the downstream side support unit 17 is attached to the holding units 63, the contact member 61 is spaced apart from the downstream side support unit 17, and a gap 19 is formed between the contact member 61 and the downstream side support unit 17. The gap 19 situated between the contact member 61 and the downstream side support unit 17 provides a working space for attaching the downstream side support unit 17 to the holding units 63 and for removing the downstream side support unit 17 from the holding units 63. That is, by providing the gap 19 between the contact member 61 and the downstream side support unit 17, attaching the downstream side support unit 17 and removing the downstream side support unit 17 are made easier.

In the printing apparatus 100, to reduce the contact area between the holding units 63 and the downstream side support unit 17, the downstream side support unit 17 is not entirely in contact with the length of each of the holding unit 63 and partially in contact with the protruding portions 67 of the holding units 63. In addition, the surface of the downstream side support unit 17 that supports the medium M is coated by a resin layer (e.g., paint), and a material that does not conduct heat easily (resins (e.g., paint)) is disposed between the downstream side support unit 17 and each of the protruding portions 67 of the holding units 63. With such a configuration, the heat of the downstream side support unit 17 heated by the first heating unit 51 is less likely to be conducted to the holding units 63 and is less likely to be taken away by the holding unit 63.

The structure that supports the downstream side support unit 17 does not have to be the holding units 63, but may be the body frame 8. Not only in the case where the holding units 63 support the downstream side support unit 17 but also in the case where body frame 8 supports the downstream side support unit 17, the area where the body frame 8 and the downstream side support unit 17 are in contact with each other may be reduced, and a material that does not conduct heat easily may be disposed on the portions where such a contact takes place.

In a direction intersecting the scanning direction X, first ends of the holding units 63 are fixed to the body frame 8 and the coupling portions 62 are coupled to second ends of the corresponding holding units 63. Each of the holding unit 63 has a narrowing width from the first end fixed to the body frame 8 towards the second end to which the coupling portion 62 is coupled. In addition, each of the holding unit 63 includes a protruding portion 64 situated at the narrowed end portion in the direction intersecting the scanning direction X. Each of the protruding portion 64 protrude towards the corresponding coupling portion 62 (in the scanning direction X).

The coupling portions 62 include a first coupling portion 62A and a second coupling portion 62B. The first coupling portion 62A is coupled to the end portion 61A situated on a first side in the longitudinal direction of the contact member 61 (scanning direction X). The second coupling portion 62B is coupled to the end portion 61B situated on a second side in the longitudinal direction of the contact member 61 (in the main scanning direction X).

The first coupling portion 62A includes a recess 62CA configured to fit onto the protruding portion 64 of the corresponding holding unit 63 and also includes a recess 62DA configured to fit onto the end portion 61A situated on a first side of the contact member 61. The protruding portion 64 of the corresponding holding unit 63 fits into the recess 62CA of the first coupling portion 62A whereas the end portion 61A situated on the first side of the contact member 61 fits into the recess 62DA of the first coupling portion 62A. The holding unit 63, the first coupling portion 62A, and the contact member 61 are fixed (fastened) to one another by the adhesive 69.

The second coupling portion 62B includes a recess 62CB configured to fit onto the protruding portions 64 of the corresponding holding unit 63 and also includes a recess 62DB configured to fit onto the end portion 61B situated on a second side of the contact member 61. The protruding portion 64 of the corresponding holding unit 63 fits into the recess 62CB of the second coupling portion 62B whereas the end portion 61B situated on the second side of the contact member 61 fits into the recess 62DB of the second coupling portion 62B. The holding unit 63, the second coupling portion 62B, and the contact member 61 are fixed (fastened) to one another by the adhesive 69.

In this way, the contact member 61 is fixed to the coupling portion 62 via the adhesive 69, the coupling portion 62 is fixed to the holding unit 63 via the adhesive 69, and the holding unit 63 is fixed to and supported by the body frame 8. The two end portions 61A and 61B of the contact member 61, which is elongated in the scanning direction X, are fixed to the corresponding holding units 63 by the respective coupling portions 62A and 62B. Consequently, the contact member 61 is fixed to the holding units 63 more firmly than when one of the two end portions 61A or 61B of the contact member 61 is fixed to the corresponding holding unit 63 by one of the corresponding coupling portions 62A or 62B. Thus, even when a stronger force is exerted by the medium M on the contact member 61, the position of the contact member 61 is less likely to change. As a result, the holding units 63 hold the contact member 61 stably via the coupling portions 62A and 62B.

The means for fixedly coupling the coupling portions 62 to the contact member 61 and to the holding units 63 is not limited to the adhesive 69. For instance, members may be fixedly coupled to each other by forming an external thread on one of the members to be fixedly coupled, forming an internal thread in the other member to be fixedly coupled, and then screwing the external thread into the internal thread. For instance, the members may be fixedly coupled to each other by a mechanical method such as riveting. For instance, the members may be fixedly coupled to each other by a method such as welding.

The coupling portions 62 are made, for example, from a resin. To be more specific, the coupling portions 62 are made from a resin that is unlikely to be deformed at the temperature of the contact member 61 (near 40~50° C. approximately). Some of the possible materials for the coupling portion 62 include, for example, general-purpose resins such as ABS resin, PVC resin, polypropylene resin, polystyrene resin, polyethylene resin, and the like. In addition to the above-mentioned general-purpose resins, resins that are more heat-resistant than the general-purpose resins (e.g., polyimide), resins that are more chemical-resistant than the general-purpose resins (e.g., Teflon®), resins that are mechanically stronger than the general-purpose resins (e.g., nylon), and the like may be used.

The thermal conductivity of the coupling portions (resin) is lower than the thermal conductivity of the holding units 63 (iron or stainless steel), and is also lower than the thermal conductivity of the contact member 61 (aluminum). As long as the thermal conductivity of the coupling portions 62 is lower than the thermal conductivity of the holding units 63, the material for the coupling portions 62 is not limited to resins, but may be, for example, ceramics.

As the thermal conductivity of the coupling portions 62 is lower than the thermal conductivity of the holding units 63, the heat of the contact member 61 heated by the medium M is less likely to be conducted to the holding units 63 via the coupling portions 62, and thus is less likely to be taken away by the holding units 63. When the contact member 61 is held directly by the holding units 63 without the help of the coupling portion 62, the thermal energy of the contact member 61 is more likely to flow out than in the case where the contact member 61 is held by the holding units 63 via the coupling portions 62. By interposing the coupling portions 62 with a lower thermal conductivity than the thermal conductivity of the holding units 63 between the contact member 61 and the holding units 63, flow out of the thermal energy of the contact member 61 is suppressed. In addition, the heat of the medium M heated by the first heating unit 51 via the downstream side support unit 17 is less likely to be conducted to the holding units 63 via the contact member 61 and the coupling portions 62, and is less likely to be taken away by the holding unit 63. Hence, the temperature of the contact member 61 heated by the medium M is less likely to change, and the temperature of the medium M that is in contact with the contact member 61 is also less likely to change.

Accordingly, as the coupling portions 62 with a low thermal conductivity (the coupling portions 62 to which heat is less likely to be conducted) are provided between the contact member 61 and the holding units 63, the temperature of the medium M heated by the first heating unit 51 via the downstream side support unit 17 is less likely to fall.

In the printing apparatus 100, the temperature of the medium M is less likely to fall when the medium M transported from the downstream side support unit 17 towards the winding unit 40 is in contact with the contact member 61. Consequently, a high-temperature state of the medium M is maintained between the downstream side support unit 17 and the winding unit 40, and a state where the ink that landed on the medium M is dried more easily by the remaining heat is also maintained in the above-mentioned section. As a result, in the printing apparatus 100, the ink that landed on the medium M is dried not only while the medium M is being supported by the downstream side support unit 17 but also while the medium M is being transported between the downstream side support unit 17 and the winding unit 40. Therefore, there is a longer time for drying the ink, which suppresses the failures caused by the insufficiently dried medium M (sticking of the medium M in the winding-side roll body 41, bleeding of images, blurring of images, and the like). In addition, the transportation speed of the medium M can be accelerated compared with the case where the medium M is dried while being supported by the downstream side support unit 17. Consequently, the efficiency (e.g., throughput) of the printing apparatus 100 is improved. In other words, in a case where, after the discharging of the medium M from the first heating unit 51, a high-temperature state of temperature of the medium M is maintained and a state where the ink is more easily dried is maintained, even at a faster transport speed of the medium M, the ink is more likely to be properly dried than in a case where, after the discharging of the medium M from the first heating unit 51, the temperature of the medium M falls and the drying of the ink is more difficult. Hence, the transport speed of the medium M is made faster and the efficiency (throughput) of the printing apparatus is enhanced.

The adhesive 69 disposed between each of the holding unit 63 and the contact member 61 is made from a resin, and the thermal conductivity of the adhesive 69 is lower than the thermal conductivity of the holding units 63. Hence, the adhesive 69 forms a part of the "coupling portion" in this application.

When no coupling portion 62 is provided between each of the holding units 63 and the contact member 61, and when the contact member 61 is fixed to the holding units 63 by the adhesive 69, a configuration where the contact member 61 is fixed to the holding units 63 by the adhesive 69 may be employed as long as the adhesive 69 is formed as, for example, a thick film that makes the conduction of the heat of the medium M to the holding units 63 substantially difficult.

Exemplary Embodiment 2

Figure 5:
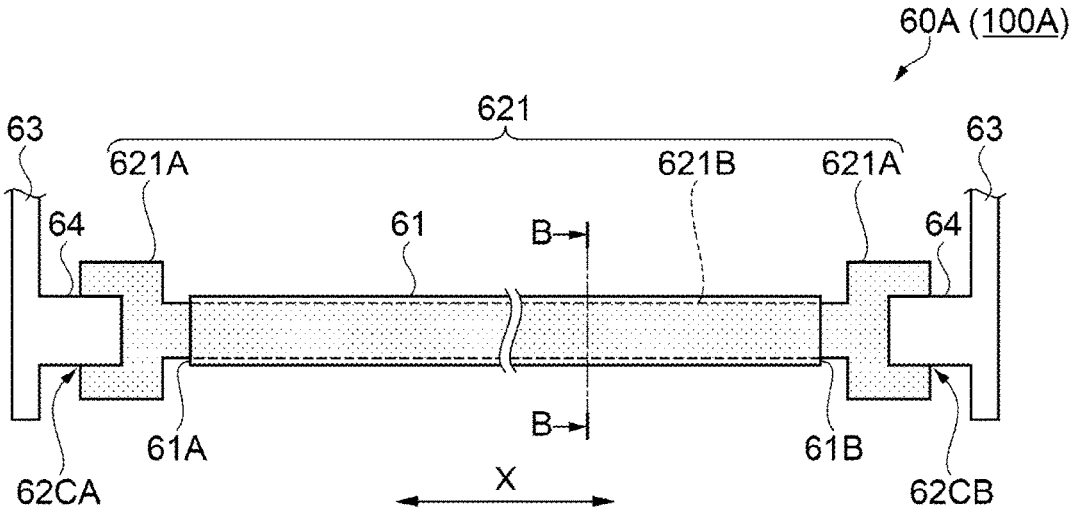
FIG. 5 is a schematic cross-sectional diagram of a guide portion mounted on a printing apparatus according to Exemplary Embodiment 2.
Figure 6:
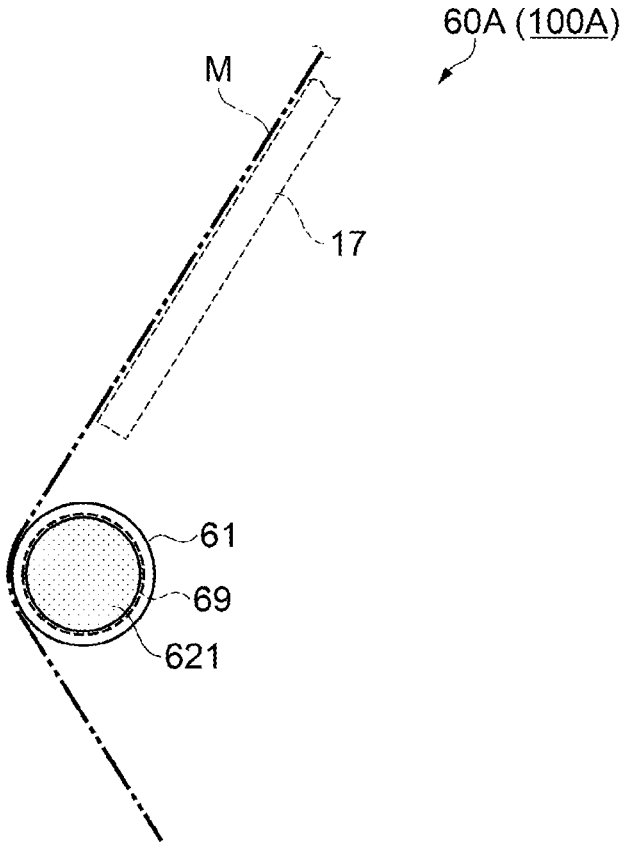
FIG. 6 is a schematic cross-sectional diagram of a guide portion taken along a line B-B of FIG. 5.

FIG. 5 is a diagram corresponding to FIG. 3, and is a schematic cross-sectional diagram of a guide portion mounted on a printing apparatus according to Exemplary Embodiment 2. FIG. 6 is a schematic cross-sectional diagram of the guide portion taken along a line B-B of FIG. 5. In addition, FIG. 5 does not illustrate the adhesive 69, and FIG. 6 illustrates the medium M with two-dot chain lines.

In a printing apparatus 100A according to Exemplary Embodiment 2, a coupling portion 621, which is a component of a guide portion 60A, has a shape that is different from the shape of the counterpart in Exemplary Embodiment 1. To be more specific, the coupling portion 621 of the guide portion 60A according to Exemplary Embodiment 2 is a member elongated in the scanning direction X whereas the coupling portion 62 of the guide portion 60 according to Exemplary Embodiment 1 includes two members of the first coupling portion 62A and the second coupling portion 62B. This is a main difference between Exemplary Embodiment 2 and Exemplary Embodiment 1.

With reference to FIG. 5 and FIG. 6, an overview of the printing apparatus 100A according to Exemplary Embodiment 2 is described below by focusing on the differences from Exemplary Embodiment 1. Here, the components that are the same as the components in Exemplary Embodiment 1 are referenced using like numbers, and no descriptions for such components are provided below.

As illustrated in FIG. 5 and FIG. 6, the coupling portion 621 included in the guide portion 60A mounted on the printing apparatus 100A according to Exemplary Embodiment 2 is a member that is elongated in the scanning direction X. The coupling portion 621 includes portions 621A configured to be coupled to the corresponding holding units 63 and a portion 621B configured to be inserted into the contact member 61.

Each of the portions 621A of the coupling portion 621 includes the recess 62CA or 62CB on the side facing the corresponding holding unit 63. The protruding portion 64 of each of the holding units 63 fits into the corresponding recess 62CA or 62CB of the coupling portion 621. Each of the holding units 63 and the corresponding portion 621A of the coupling portion 621 are fixed (fastened) to each other by the adhesive 69 (not illustrated).

The portion 621B of the coupling portion 621 is a cylindrical-shaped member that is elongated in the scanning direction X. An external dimension of the portion 621B in a direction intersecting the scanning direction X is shorter than an external dimension of the portion 621A.

The contact member 61 is formed with the longitudinal direction of the contact member 61 aligned with the scanning direction X that intersects the transport direction F, and there is a cavity in the contact member 61. The portion 621B of the coupling portion 621 is inserted into the cavity of the contact member 61. In other words, the portion 621B of the coupling portion 621 is formed to pass through the contact member 61 from the end portion 61A situated on the first side of the contact member 61 in the scanning direction X to the end portion 61B situated on the second side of the contact member 61 in the scanning direction X.

In addition, in the portion where the portion 621B of the coupling portion 621 is inserted into the contact member 61, the adhesive 69 is disposed between the portion 621B and the contact member 61, and the contact member 61 is fixed by the adhesive 69 to the portion 621B of the coupling portion 621.

Note that instead of providing the adhesive 69 between the portion 621B and the contact member 61, the portion 621B of the coupling portion 621 may be formed as a pivot shaft that allows the contact member 61 to rotate about the pivot shaft.

In the printing apparatus 100A according to Exemplary Embodiment 2, a coupling portion 62 with a low thermal conductivity is disposed between each of the holding units 63 and the contact member 61. When the medium M transported from the downstream side support unit 17 towards the winding unit 40 is in contact with the contact member 61, the temperature of the medium M is less likely to fall as the heat of the medium M is less likely to be conducted to the holding units 63. Consequently, the high-temperature state of the medium M is maintained between the downstream side support unit 17 and the winding unit 40, and a state where the ink that landed on the medium M is dried more easily by the remaining heat is also maintained in the above-mentioned section. Accordingly, similar effects to the effects obtainable in Exemplary Embodiment 1 are obtained. Specifically, what is obtained is that the efficiency of the printing apparatus 100A is improved while the failures caused by the insufficient drying of the medium M are suppressed.

In Exemplary Embodiment 1, some parts (end portions 61A and 61B) of the contact member 61 elongated in the scanning direction X are supported by the coupling portions 62. When the contact member 61 is formed thinner, the mechanical strength of the contact member 61 becomes weaker and the contact member 61 becomes more deformable by the force applied by the medium M. Hence, it is difficult for the contact member 61 to be formed thinner.

In Exemplary Embodiment 2, the coupling portion 621 is inserted into the contact member 61, and the entirety of the contact member 61 elongated in the scanning direction X is supported by the coupling portion 621. Hence, the mechanical strength of the contact member 61 is enhanced by the coupling portion 621, and the contact member 61 becomes more resistant against the deformation that would otherwise be caused by a force applied by the medium M. Accordingly, in comparison to Exemplary Embodiment 1, the thickness of the contact member 61 is made thinner, and the heat capacity of the contact member 61 is made lower. With a lower heat capacity of the contact member 61, the amount of heat conducted from the medium M to the contact member 61 becomes smaller when the medium M is in contact with the contact member 61. Hence, an effect is obtainable such that the heat of the medium M is less likely to be taken away by the contact member 61, and thus the temperature of the medium M is even less likely to change (fall).

Exemplary Embodiment 3

Figure 7:
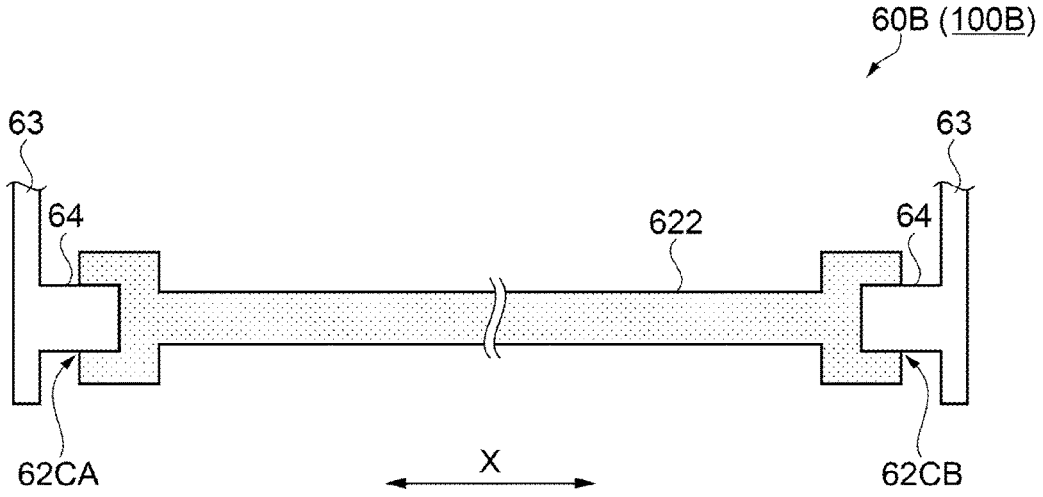
FIG. 7 is a schematic cross-sectional diagram of a guide portion mounted on a printing apparatus according to Exemplary Embodiment 3.

FIG. 7 is a diagram corresponding to FIG. 5, and is a schematic cross-sectional diagram of a guide portion mounted on a printing apparatus according to Exemplary Embodiment 3. In addition, FIG. 7 does not illustrate the adhesive 69.

A guide portion 60B according to Exemplary Embodiment 3 does not include the contact member 61 that is included in Exemplary Embodiment 2. The guide portion 60B includes a coupling portion 622 and the holding units 63. That is, the coupling portion 622 in the guide portion 60B according to Exemplary Embodiment 3 serves also as the contact member 61. This is a main difference between Exemplary Embodiment 3 and Exemplary Embodiment 2.

With reference to FIG. 7, an overview of a printing apparatus 100B according to Exemplary Embodiment 3 is described below by focusing on the differences from Exemplary Embodiment 2. Here, the components that are the same as the components in Exemplary Embodiment 2 are referenced using like numbers, and no descriptions for such components are provided below.

As illustrated in FIG. 7, the coupling portion 622 included in the guide portion 60B mounted on the printing apparatus 100B according to Exemplary Embodiment 3 is a member that is elongated in the scanning direction X. The coupling portion 622 has the same shape as the shape of the coupling portion 621 according to Exemplary Embodiment 2. The protruding portions 64 of the holding units 63 fit into the corresponding recess 62CA and 62CB of the coupling portion 622. Each of the holding units 63 and the coupling portion 622 are fixed (fastened) to each other by the adhesive 69 (not illustrated).

The coupling portion 622 is made from a mechanically strong resin, and is in contact with the medium M. Thus, the coupling portion 622 guides the medium M to allow the medium M to be wound properly by the winding unit 40. For instance, a glass-fiber reinforced resin (e.g., glass-fiber reinforced polyamide resin), a polyether ether ketone resin, a polyphenylene sulfide resin, and the like may be used as the material for the coupling portion 622. In addition, the thermal conductivity of the coupling portion 622 (mechanically strong resin) is lower than the thermal conductivity of the holding units 63 (iron or stainless steel).

In Exemplary Embodiment 3, the coupling portion 622 configured to guide the medium M is made from a material to which heat is less likely to be conducted. Hence, when the medium M transported from the downstream side support unit 17 towards the winding unit 40 is in contact with the coupling portion 622, the temperature of the medium M is less likely to fall as the heat of the medium M is less likely to be conducted to the holding units 63. Consequently, the high-temperature state of the medium M is maintained between the downstream side support unit 17 and the winding unit 40, and a state where the ink that landed on the medium M is dried more easily by the remaining heat is also maintained in the above-mentioned section. Accordingly, similar effects to the effects obtainable in Exemplary Embodiment 2 are obtained. Specifically, what is obtained is that the efficiency of the printing apparatus 100B is improved while the failures caused by the insufficient drying of the medium M are suppressed.

In addition, the guide portion 60B according to Exemplary Embodiment 3 does not include a contact member 61, but the coupling portion 622 serves also as the contact member 61. Hence, as compared to the guide portion 60A according to Exemplary Embodiment 2 including the contact member 61, the guide portion 60B is composed of a smaller number of constituent parts and is manufactured at a lower cost.

Exemplary Embodiment 4

Figure 8:
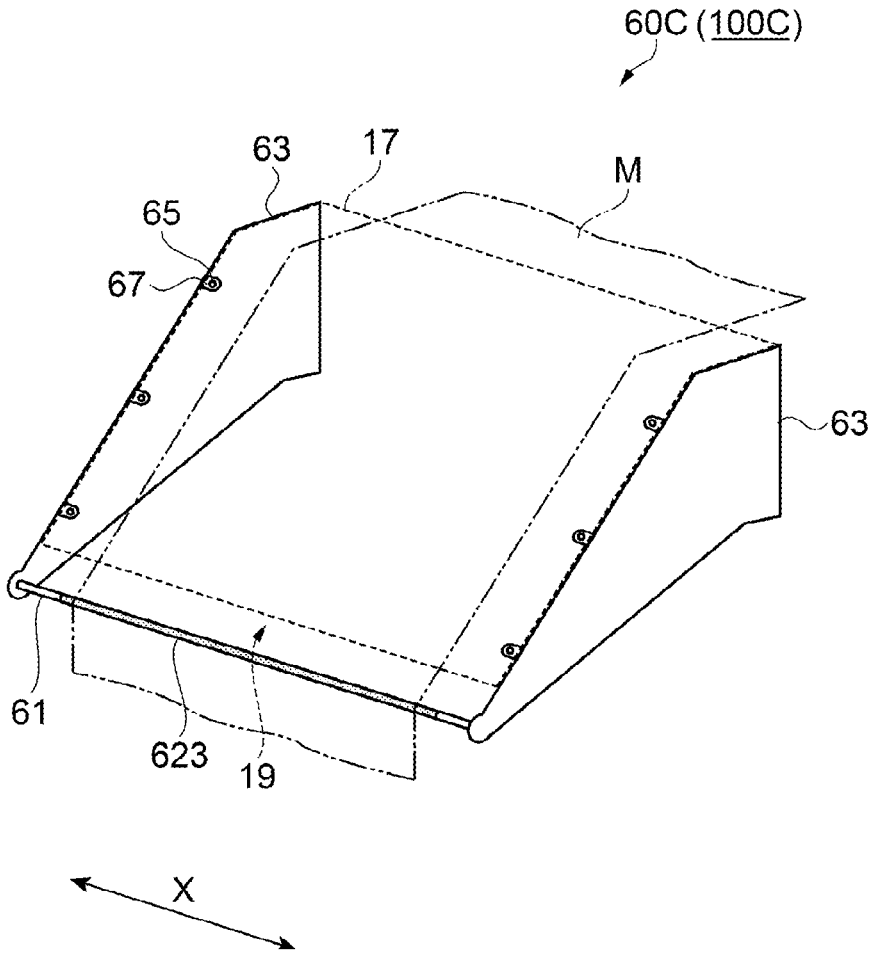
FIG. 8 is a perspective view of a guide portion mounted on a printing apparatus according to Exemplary Embodiment 4.
Figure 9:
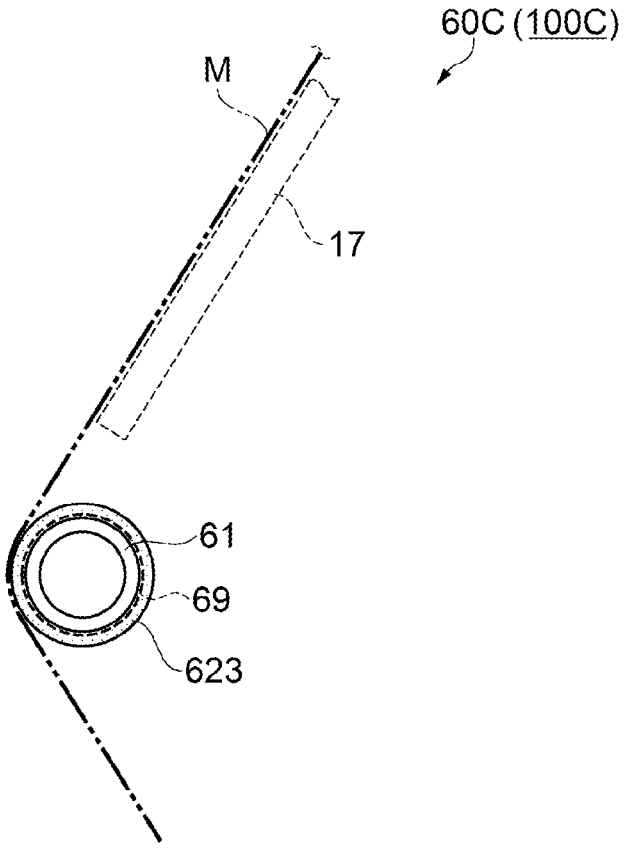
FIG. 9 is a schematic cross-sectional diagram of a guide portion according to Exemplary Embodiment 4.

FIG. 8 is a diagram corresponding to FIG. 2, and is a perspective view of a guide portion mounted on a printing apparatus according to Exemplary Embodiment 4. FIG. 9 is a diagram corresponding to FIG. 6, and is a schematic cross-sectional diagram of the guide portion according to Exemplary Embodiment 4.

In a guide portion 60C according to Exemplary Embodiment 4, the shape of the coupling portion 623 and the position of the coupling portion 623 differ from the shape and the position of the coupling portion in the Exemplary Embodiment 1. In addition, the contact member 61 is fixed directly to the holding units 63. These are the main differences between Exemplary Embodiment 4 and Exemplary Embodiment 1.

With reference to FIG. 8 and FIG. 9, an overview of a printing apparatus 100C according to Exemplary Embodiment 4 is described below by focusing on the differences from Exemplary Embodiment 1. Here, the components that are the same as the components in Exemplary Embodiment 1 are referenced using like numbers, and no descriptions for such components are provided below.

As illustrated in FIG. 8 and FIG. 9, the coupling portion 623 included in the guide portion 60C mounted on the printing apparatus 100C according to Exemplary Embodiment 4 is a resin tube elongated in the scanning direction X. In addition, the coupling portion 623 is provided to cover the surface of the contact member 61 instead of being disposed between each of the holding units 63 and the contact member 61. That is, the contact member 61 is inserted into the coupling portion 623 and is covered with the coupling portion 623. In addition, the adhesive 69 is disposed between the coupling portion 623 and the contact member 61. Thus, the coupling portion 623 and the contact member 61 are fixed to each other by the adhesive 69. In Exemplary Embodiment 4, the medium M is thus in contact with the coupling portion 623 instead of being in contact with the contact member 61.

Moreover, each of the holding units 63 and the contact member 61 are fixed to each other by a screw (not illustrated).

The coupling portion 623 is made from the same material (resin) as the material for the coupling portion 62 of Exemplary Embodiment 1. The thermal conductivity of the coupling portion 623 is lower than the thermal conductivity of the contact member 61 (aluminum) and is also lower than the thermal conductivity of the holding unit 63 (iron or stainless steel).

In the printing apparatus 100C according to Exemplary Embodiment 4, the coupling portion 623 with a low thermal conductivity is disposed between the medium M and the contact member 61. Hence, the heat of the medium M is less likely to be conducted to the contact member 61, and the temperature of the medium M is less likely to fall. Consequently, the high-temperature state of the medium M is maintained between the downstream side support unit 17 and the winding unit 40, and a state where the ink that landed on the medium M is dried more easily by the remaining heat is also maintained in the above-mentioned section. Accordingly, similar effects to the effects obtainable in Exemplary Embodiment 1 are obtained. Specifically, what is obtained is that the efficiency of the printing apparatus 100C is improved while the failures caused by the insufficient drying of the medium M are suppressed.

The coupling portion 623 may be disposed between the medium M and the contact member 61. Specifically, the coupling portion 623 may be provided to cover the entire surface of the contact member 61, or the coupling portion 623 may be provided to cover a part of the surface of the contact member 61.

Exemplary Embodiment 5

Figure 10:
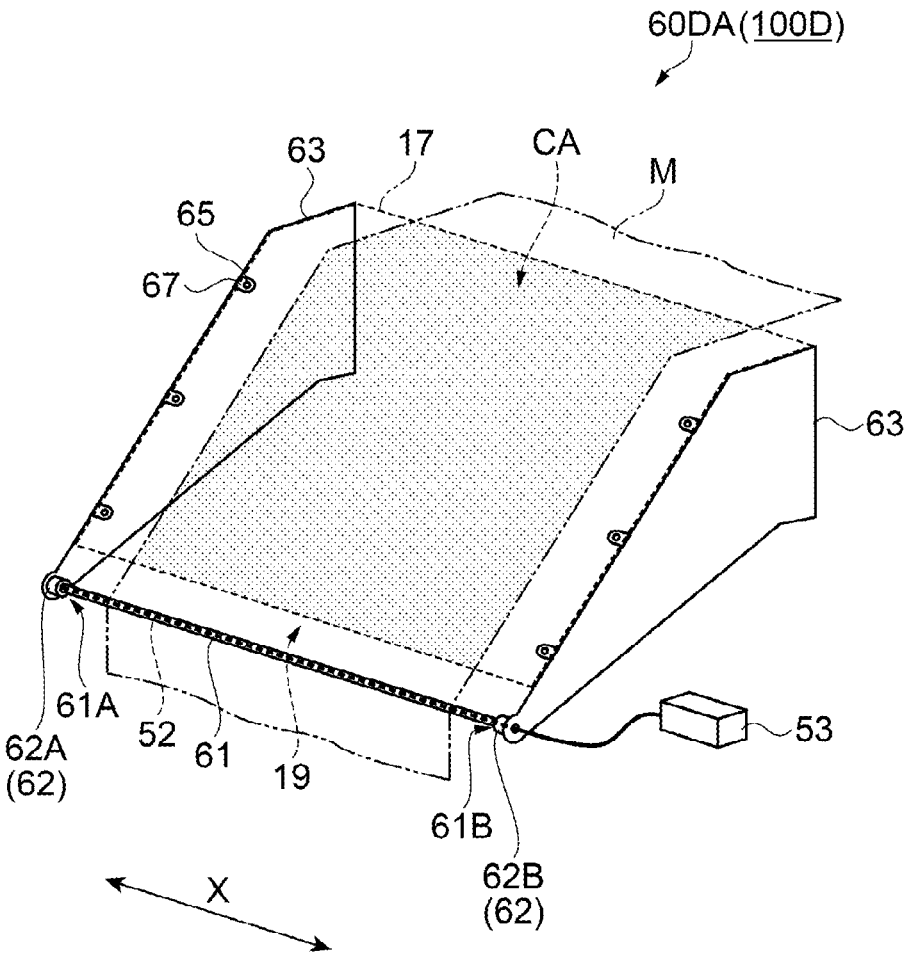
FIG. 10 is a perspective view of a guide portion mounted on a printing apparatus according to Exemplary Embodiment 5.
Figure 11:
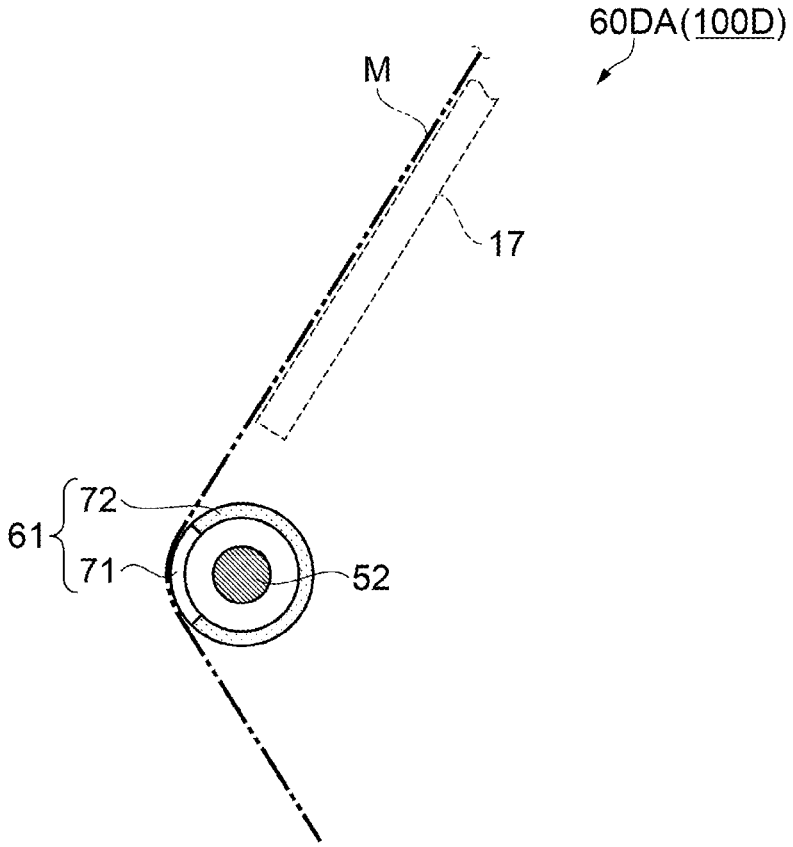
FIG. 11 is a schematic cross-sectional diagram of a guide portion according to Exemplary Embodiment 5.
Figure 12:
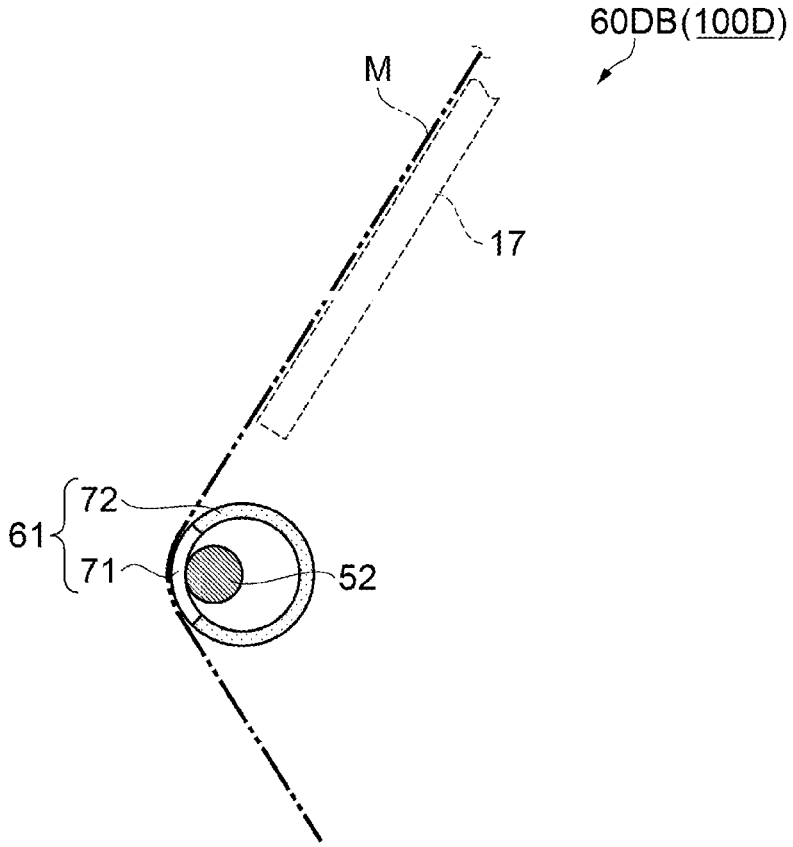
FIG. 12 is a schematic cross-sectional diagram of another guide portion according to Exemplary Embodiment 5.

FIG. 10 is a diagram corresponding to FIG. 2, and is a perspective view of a guide portion mounted on a printing apparatus according to Exemplary Embodiment 5. FIG. 11 is a diagram corresponding to FIG. 6, and is a schematic cross-sectional diagram of the guide portion according to Exemplary Embodiment 5. FIG. 12 is a diagram corresponding to FIG. 11, and is a schematic cross-sectional diagram of another guide portion according to Exemplary Embodiment 5.

A guide portion 60DA or 60DB according to Exemplary Embodiment 5 includes a second heating unit 52 configured to heat the contact member 61. This is a main difference from Exemplary Embodiment 1.

With reference to FIG. 10 and FIG. 11, an overview of a printing apparatus 100D according to Exemplary Embodiment 5 is described below by focusing on the differences from Exemplary Embodiment 1. Here, the components that are the same as the components in Exemplary Embodiment 1 are referenced using like numbers, and no descriptions for such components are provided below.

As illustrated in FIG. 10 and FIG. 11, the guide portion 60DA mounted on the printing apparatus 100D according to Exemplary Embodiment 5 includes the coupling portions 62 each of which is situated between the contact member 61 and the corresponding holding unit 63. In addition, the guide portion 60DA further includes the second heating unit 52 configured to heat the contact member 61.

The contact member 61 is a hollow pipe elongated in the scanning direction X with a cavity inside of the contact member 61. The contact member 61 includes a contact area 71 in contact with the medium M while the guide portion 60DA is guiding the medium M, and a non-contact area 72 not in contact with the medium M while the guide portion 60DA is guiding the medium M. The non-hatched area in FIG. 11 represents the contact area 71 of the guide portion 60DA that is in contact with the medium M, whereas the hatched area represents the non-contact area 72 of the guide portion 60DA that is not in contact with the medium M.

The second heating unit 52 is disposed on the inside of the contact member 61 (in the cavity of the contact member 61) not in contact with the contact area 71 of the guide portion 60DA or with the non-contact area 72 of the guide portion 60DA. In other words, the second heating unit 52 is disposed on the inside of the contact member 61. The second heating unit 52 is, for instance, an infrared heater configured to heat by infrared rays and/or far infrared rays. As the second heating unit 52, not only an infrared heater but also a sheath heater including an internal heating element (nichrome wire) and a ceramic heater using ceramics as a heating element may be used.

At the end portion 61B on a second side of the contact member 61 in the scanning direction X, the second heating unit 52 is coupled with a power source 53 that is disposed outside of the holding unit 63 and that passes through the second coupling portion 62B and the holding unit 63. By supplying power from the power source 53 to the second heating unit 52, the second heating unit 52 is heated and the contact member 61 is heated from the inside of the contact member 61 by the second heating unit 52.

The second heating unit 52 is positioned at the center in the cavity of the contact member 61. Hence, as compared with a case where the second heating unit 52 is not positioned at the center in the cavity of the contact member 61, the contact member 61 is heated more evenly from the inside of the contact member 61. In addition, when the second heating unit 52 is disposed inside of (within) the contact member 61, the guide portion 60DA is constructed with a space-saving configuration as compared to a case where the second heating unit 52 is disposed outside of (not within) the contact member 61.

In the printing apparatus 100D according to Exemplary Embodiment 5, the coupling portion 62 with a low thermal conductivity is disposed between each of the holding units 63 and the contact member 61. Hence, the temperature of the medium M heated by the first heating unit 51 via the downstream side support unit 17 is less likely to fall. Consequently, the high-temperature state of the medium M is maintained between the downstream side support unit 17 and the winding unit 40, and a state where the ink that landed on the medium M is dried more easily by the remaining heat is also maintained in the above-mentioned section. Accordingly, similar effects to the effects obtainable in Exemplary Embodiment 1 are obtained. Specifically, what is obtained is that the efficiency of the printing apparatus 100D is improved while the failures caused by the insufficient drying of the medium M are suppressed.

In addition, in the printing apparatus 100D according to Exemplary Embodiment 5, the contact member 61 is heated by the second heating unit 52. Hence, as compared to a configuration where the contact member 61 is not heated (i.e., the printing apparatus 100 of Exemplary Embodiment 1), the temperature of the medium M becomes higher between the downstream side support unit 17 and the winding unit 40, and the ink that landed on the medium M is dried quickly. In addition, the transport speed of the medium M is accelerated to further enhance the efficiency (throughput) of the printing apparatus 100D.

In the guide portion 60DB, the position of the second heating unit 52 is not limited to the center of the cavity of the contact member 61. Instead, as illustrated in FIG. 12, the second heating unit 52 may be disposed at a position that is not the center of the cavity of the contact member 61. Specifically, the second heating unit 52 is positioned inside of the contact member 61 to be in contact with the contact area 71 of the contact member 61. In the guide portion 60DB, when the second heating unit 52 is positioned to be in contact with the contact area 71 of the contact member 61, the contact area 71 of the contact member 61 is heated quickly and efficiently.

As such, the second heating unit 52 may be disposed inside of the contact member 61. For instance, the second heating unit 52 may be positioned at the center of the cavity of the contact member 61 (the configuration illustrated in FIG. 11), and, for instance, the second heating unit 52 may be positioned to be in contact with the contact area 71 of the contact member 61 (the configuration illustrated in FIG. 12).

Exemplary Embodiment 6

Figure 13:
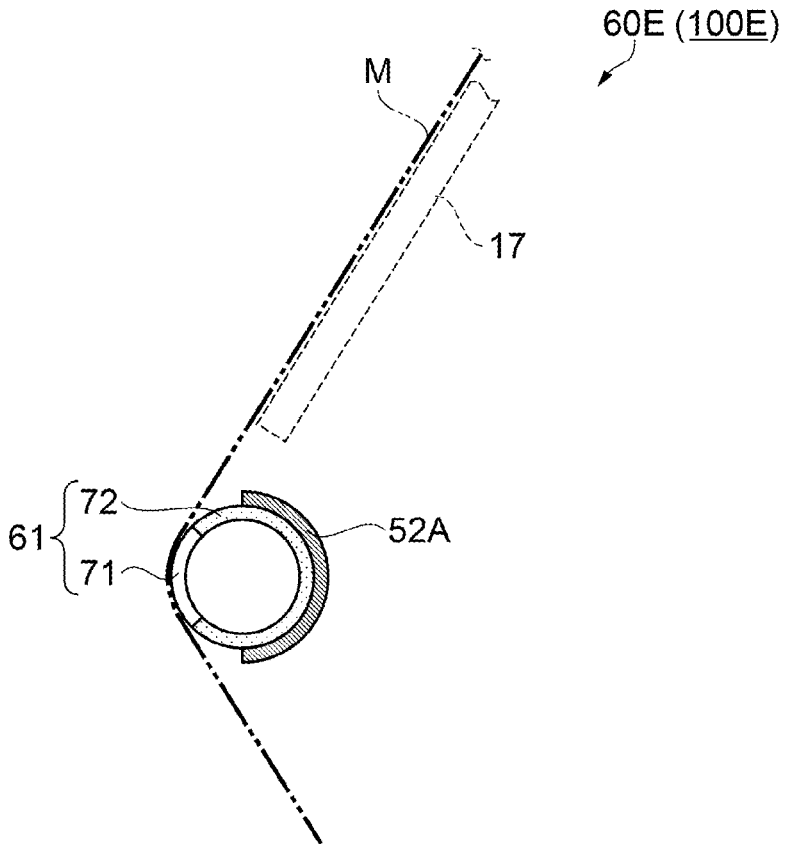
FIG. 13 is a schematic cross-sectional diagram of a guide portion mounted on a printing apparatus according to Exemplary Embodiment 6.

FIG. 13 is a diagram corresponding to FIG. 12, and is a schematic cross-sectional diagram of a guide portion mounted on a printing apparatus according to Exemplary Embodiment 6.

In the guide portion 60DA or 60DB according to Exemplary Embodiment 5, the second heating unit 52 is positioned inside of the hollow contact member 61, but in a guide portion 60E according to Exemplary Embodiment 6, a second heating unit 52A is positioned outside of the hollow contact member 61. This is a main difference between Exemplary Embodiment 6 and Exemplary Embodiment 5.

With reference to FIG. 13, an overview of a printing apparatus 100E according to Exemplary Embodiment 6 is described below by focusing on the differences from Exemplary Embodiment 5. Here, the components that are the same as the components in Exemplary Embodiment 5 are referenced using like numbers, and no descriptions for such components are provided below.

As illustrated in FIG. 13, the guide portion 60E mounted on the printing apparatus 100E according to Exemplary Embodiment 6 includes the coupling portions 62 each of which is situated between the contact member 61 and the corresponding holding unit 63. In addition, in the guide portion 60E, the second heating unit 52A is attached to the surface (outside) of the hollow contact member 61. To be more specific, the second heating unit 52A is, for example, a panel heater formed by pasting a heating element to a member having an excellent thermal conductivity (aluminum foil). The second heating unit 52A is pasted to the non-contact area 72 of the surface of the contact member 61 by a double sided tape (not illustrated) having an excellent heat resistance.

In other words, the contact member 61 includes the contact area 71 in contact with the medium M while the medium M is being guided, and the non-contact area 72 not in contact with the medium M while the medium M is being guided. The second heating unit 52A is disposed at least in the non-contact area 72.

Note that the second heating unit 52A may be disposed in the contact area 71 of the contact member 61. When the second heating unit 52A is disposed in the contact area 71 of the contact member 61, the second heating unit 52A creates unnecessary irregularities in the contact area 71 of the contact member 61. While the medium M is being guided (is being transported) in contact with the contact area 71, the guiding of the medium M (transportation of the medium) may be obstructed by such unnecessary irregularities. When the second heating unit 52A is disposed in the non-contact area 72, the second heating unit 52A creates no unnecessary irregularities in the contact area 71. Hence, an obstruction in the guiding of the medium M (the transportation of the medium) is suppressed.

Accordingly, the second heating unit 52A may be disposed in the non-contact area 72.

In addition, in the printing apparatus 100E according to Exemplary Embodiment 6, the contact member 61 is heated by the second heating unit 52A. Hence, as compared to a configuration where the contact member 61 is not heated (i.e., the printing apparatus 100 of Exemplary Embodiment 1), the temperature of the medium M becomes higher between the downstream side support unit 17 and the winding unit 40, and the ink that landed on the medium M is dried quickly. In addition, the transport speed of the medium M is accelerated to further enhance the efficiency (throughput) of the printing apparatus 100E. As such, similar effects to the effects obtainable in Exemplary Embodiment 5 are obtained.

In addition, for instance, by combining the configuration of Exemplary Embodiment 5 with the configuration of Exemplary Embodiment 6, the second heating units 52 and 52A may be disposed both inside and outside of the contact member 61.

Exemplary Embodiment 7

Figure 14:
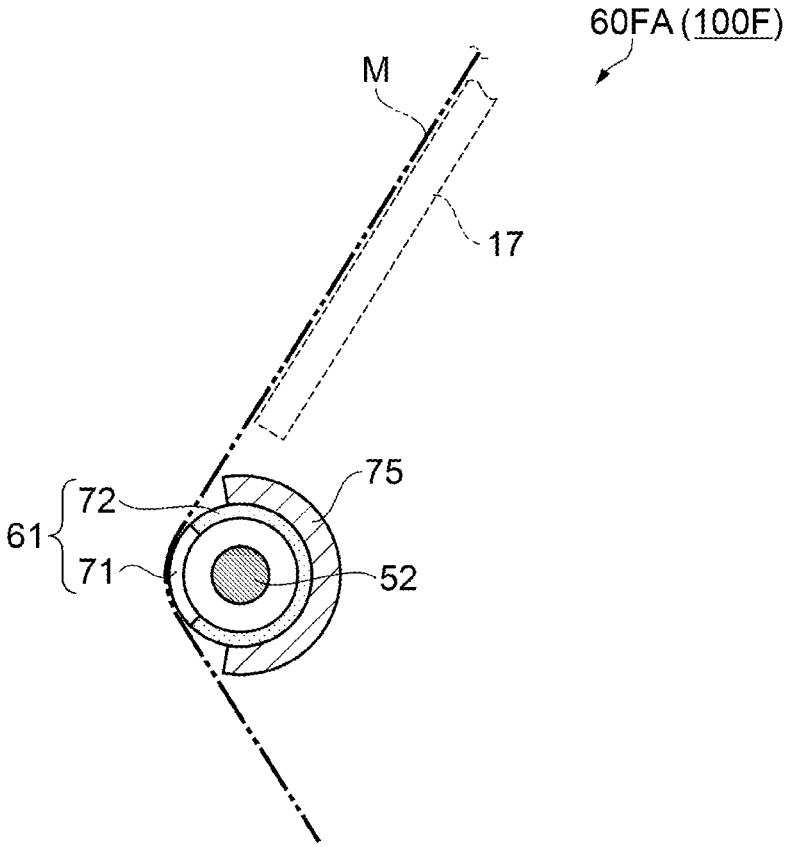
FIG. 14 is a schematic cross-sectional diagram of a guide portion mounted on a printing apparatus according to Exemplary Embodiment 7.
Figure 15:
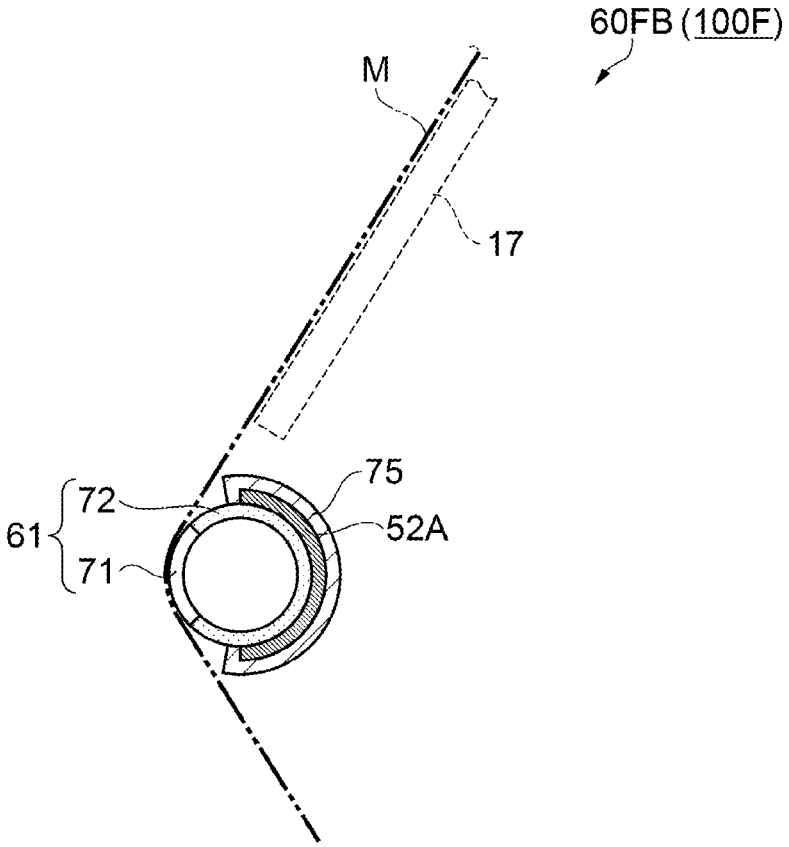
FIG. 15 is a schematic cross-sectional diagram of another guide portion according to Exemplary Embodiment 7.

FIG. 14 is a diagram corresponding to FIG. 11, and is a schematic cross-sectional diagram of a guide portion mounted on a printing apparatus according to Exemplary Embodiment 7. FIG. 15 is a diagram corresponding to FIG. 13, and is a schematic cross-sectional diagram of another guide portion according to Exemplary Embodiment 7.

A guide portion 60FA or 60FB according to Exemplary Embodiment 7 includes a new cover 75. This is a main difference of Exemplary Embodiment 7 from Exemplary Embodiment 5 and Exemplary Embodiment 6.

With reference to FIG. 14 and FIG. 15, an overview of a printing apparatus 100F according to Exemplary Embodiment 7 is described below by focusing on the differences from Exemplary Embodiment 5 and Exemplary Embodiment 6. Here, the components that are the same as the components in Exemplary Embodiment 5 and Exemplary Embodiment 6 are referenced using like numbers, and no descriptions for such components are provided below.

As illustrated in FIG. 14, the guide portion 60FA mounted on the printing apparatus 100F according to Exemplary Embodiment 7 includes the coupling portions 62 each of which is situated between the contact member 61 and the corresponding holding unit 63. The guide portion 60FA also includes a second heating unit 52 situated inside of the contact member 61 and configured to heat the contact member 61. In addition, in the guide portion 60FA, the cover 75, which is an exemplar "low-thermal-conductivity member", is attached to cover a non-contact area 72 of the surface of the contact member 61.

The cover 75 is made from the same material (resin) as the material for the coupling portion 62 of Exemplary Embodiment 1. The thermal conductivity of the cover 75 is lower than the thermal conductivity of the contact member 61 (aluminum) and is also lower than the thermal conductivity of the holding unit 63 (iron or stainless steel).

In other words, the contact member 61 includes a contact area 71 in contact with the medium M while the medium M is being guided, and the non-contact area 72 not in contact with the medium M while the medium M is being guided. The cover 75 with a lower thermal conductivity than the thermal conductivity of the contact member 61 is attached to the non-contact area 72.

By attaching the cover 75 with a lower thermal conductivity than the thermal conductivity of the contact member 61 to the non-contact area 72, the heat of the contact member 61 heated by the second heating unit 52 is made less likely to be taken away as compared to a configuration where no cover 75 is attached to the contact member 61 (configuration of Exemplary Embodiment 5). In addition, the heat retaining property of the contact member 61 is enhanced so that the temperature of the contact member 61 heated by the second heating unit 52 is made less likely to fall.

Hence, as compared to a configuration where no cover 75 is attached to the contact member 61 (the configuration of Exemplary Embodiment 5), the following effects are obtained. The temperature of the contact member 61 heated by the second heating unit 52 is less likely to fall between the downstream side support unit 17 and the winding unit 40, the temperature of the medium M is raised efficiently, the ink that landed on the medium M is dried quickly, and the transport speed of the medium M is accelerated. Thus, the efficiency (throughput) of the printing apparatus 100F is further enhanced.

As another example according to Exemplary Embodiment 7, the guide portion 60FB mounted on the printing apparatus 100F according to Exemplary Embodiment 7 includes the coupling portions 62 each of which is situated between the contact member 61 and the corresponding holding unit 63 as illustrated in FIG. 15. In addition, the second heating unit 52A is attached to the non-contact area 72 of the surface of the contact member 61. Furthermore, in the guide portion 60FB, the cover 75, which is an exemplar "low-thermal-conductivity member", is attached to cover both the non-contact area 72 of the surface of the contact member 61 and the surface of the second heating unit 52A attached to the non-contact area 72.

That is, the contact member 61 includes the contact area 71 in contact with the medium M while the medium M is being guided, and the non-contact area 72 not in contact with the medium M while the medium M is being guided. The cover 75 with a lower thermal conductivity than the thermal conductivity of the contact member 61 is attached to the non-contact area 72.

By attaching the cover 75 with a lower thermal conductivity than the thermal conductivity of the contact member 61 to the non-contact area 72, as compared to a configuration where no cover 75 is attached to the contact member 61 (the configuration of Exemplary Embodiment 6), the following effects are obtained. The temperature of the contact member 61 heated by the second heating unit 52 is less likely to fall between the downstream side support unit 17 and the winding unit 40, the temperature of the medium M is raised efficiently, the ink that landed on the medium M is dried quickly, and the transport speed of the medium M is accelerated. Thus, the efficiency (throughput) of the printing apparatus 100F is further enhanced.

In Exemplary Embodiment 5 to Exemplary Embodiment 7, the coupling portion 62 with a low thermal conductivity is disposed between the contact member 61 and the holding unit 63, which makes the configuration less likely to allow the heat of the contact member 61 to be conducted to the holding units 63. In addition, the configuration is configured to raise the temperature of the contact member 61 up to a target temperature by the second heating units 52 and 52A.

With a configuration where the heat of the contact member 61 is less likely to be conducted to the holding units 63 (a configuration including the coupling portions 62), even when the thermal energy (power consumption) of the second heating units 52 and 52A is reduced from the case of a configuration where the heat of the contact member 61 is more likely to be conducted to the holding units 63 (a configuration with no coupling portions 62), the temperature of the contact member 61 is raised up to a target temperature and thus the energy saving is achieved.

In addition, as the heat of the contact member 61 is less likely to be conducted to the holding units 63, the temperature difference within the contact member 61 between sides near the holding units 63 and sides far from the holding units 63 becomes smaller, resulting in a more uniform temperature distribution in the contact member 61. Hence in Exemplary Embodiment 5 to Exemplary Embodiment 7, the temperature uniformity across the contact member 61 heated by the second heating units 52 and 52A is enhanced and thus the temperature uniformity across the medium M heated by the contact member 61 is also enhanced. Thus, an effect such that the ink that landed on the medium M is dried quickly and an effect such that the ink that landed on the medium M is more likely to be dried uniformly are obtained.

Even with a configuration where no coupling portions 62 having a low thermal conductivity is provided between the contact member 61 and the corresponding holding units 63 and where the second heating units 52 and 52A configured to heat the contact member 61 are provided, the thermal energy of the second heating unit 52 and 52A is conducted to the medium M via the contact member 61, the temperature of the medium M is raised, and the ink that landed on the medium M is dried properly. Thus, the failures caused by the insufficiently dried medium M (sticking of the medium M in the winding-side roll body 41, bleeding of images, blurring of images, and the like) are suppressed, and some challenges set for this application are addressed properly.

Accordingly, a configuration may be employed where the coupling portion 62 having a low thermal conductivity is not provided between the contact member 61 and the corresponding holding unit 63 and where the second heating units 52 and 52A are provided to heat the contact member 61.

Exemplary Embodiment 8

Figure 16:
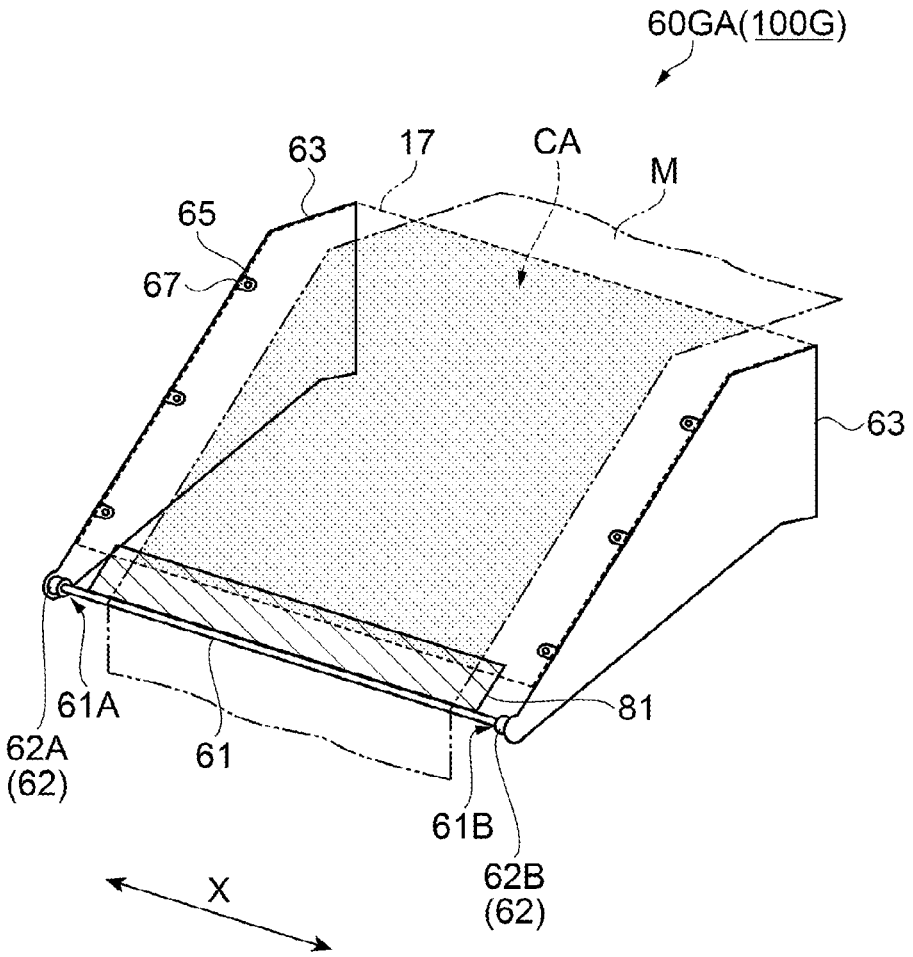
FIG. 16 is a perspective view of a guide portion mounted on a printing apparatus according to Exemplary Embodiment 8.
Figure 17:
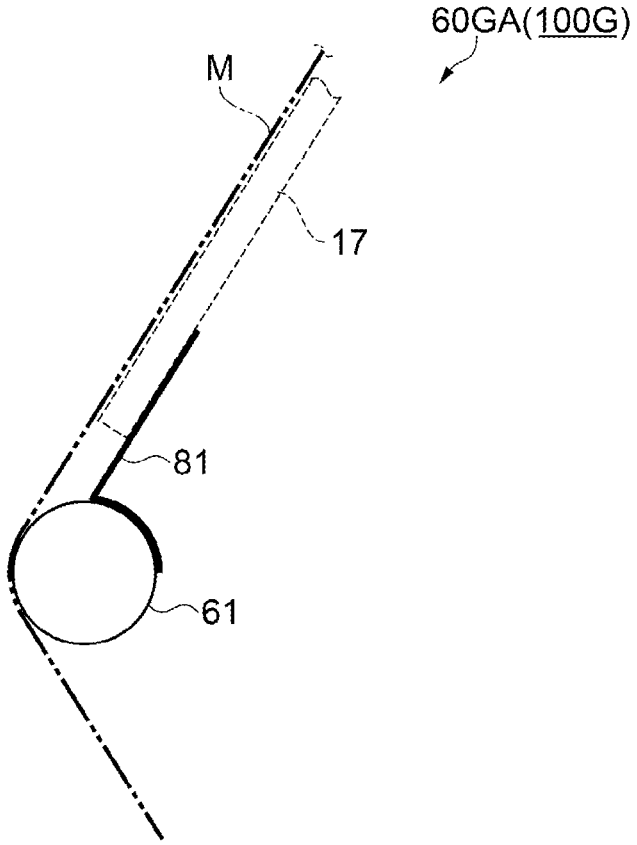
FIG. 17 is a schematic cross-sectional diagram of a guide portion according to Exemplary Embodiment 8.
Figure 18:
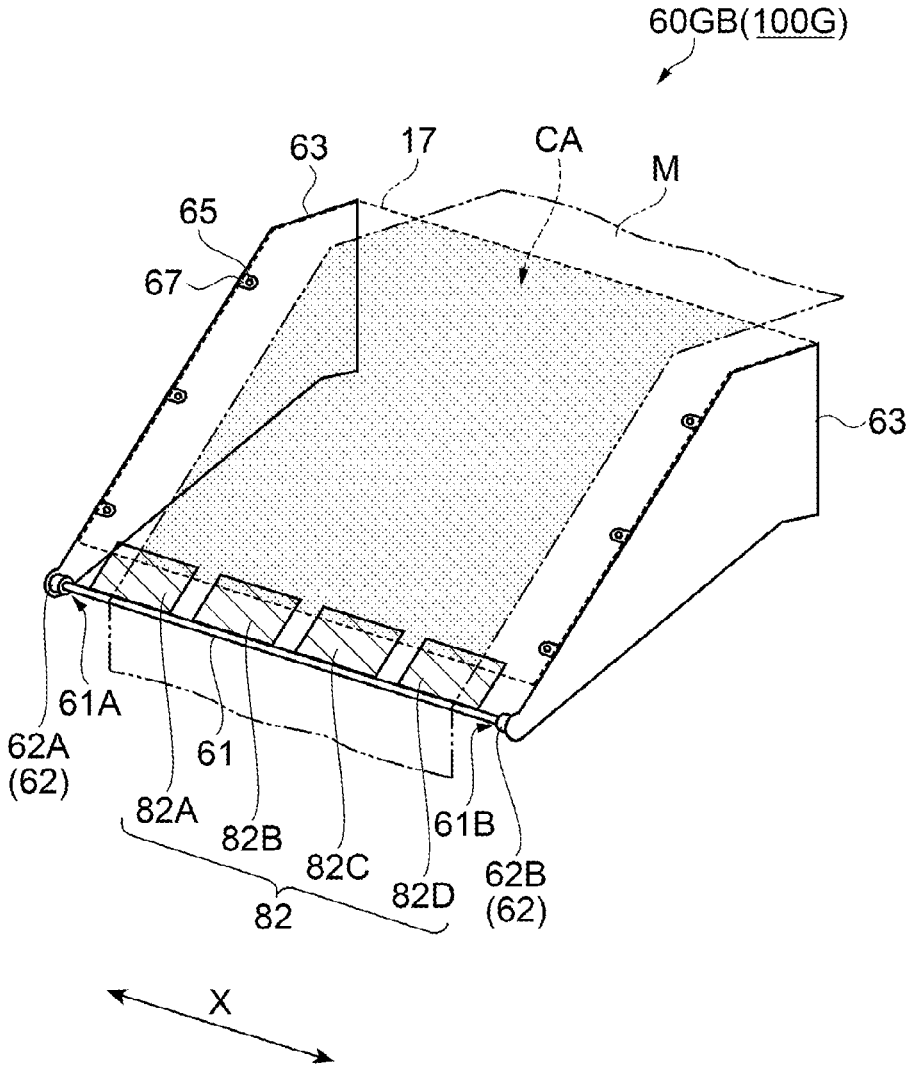
FIG. 18 is a perspective view of another guide portion according to Exemplary Embodiment 8.

FIG. 16 is a diagram corresponding to FIG. 2, and is a perspective view of a guide portion mounted on a printing apparatus according to Exemplary Embodiment 8. FIG. 17 is a diagram corresponding to FIG. 6, and is a schematic cross-sectional diagram of the guide portion according to Exemplary Embodiment 8. FIG. 18 is a perspective view of another guide portion according to Exemplary Embodiment 8.

A guide portion 60GA and a guide portion 60GB according to Exemplary Embodiment 8 include a heat-conduction portion 81 and a heat-conduction portion 82, respectively. Each of the heat-conduction portions 81 and 82 is in contact with both the downstream side support unit 17 and the contact member 61. This is a main difference between Exemplary Embodiment 8 and Exemplary Embodiment 1.

With reference to FIG. 16 and FIG. 17, an overview of a printing apparatus 100G according to Exemplary Embodiment 8 is described below by focusing on the differences from Exemplary Embodiment 1. Here, the components that are the same as the components in Exemplary Embodiment 1 are referenced using like numbers, and no descriptions for such components are provided below.

As illustrated in FIG. 16, the guide portion 60GA mounted on the printing apparatus 100G according to Exemplary Embodiment 8 includes the coupling portions 62 each of which is situated between the contact member 61 and the corresponding holding unit 63. In addition, the guide portion 60GA further includes the heat-conduction portion 81 configured to be in contact with both the downstream side support unit 17 and the contact member 61.

The heat-conduction portion 81 is a sheet-like member elongated in the scanning direction X. The heat-conduction portion 81 is disposed to fill the gap 19 (see FIG. 2) between the downstream side support unit 17 and the contact member 61. The heat-conduction portion 81 is fixed to both the downstream side support unit 17 and the contact member 61 with heat-resistant double sided tape, and is in contact with both the downstream side support unit 17 and the contact member 61. The heat-conduction portion 81 may be fixed to the downstream side support unit 17 and the contact member 61 by screws and/or adhesives.

The heat-conduction portion 81 is a graphite sheet made by processing graphite (black lead) into a sheet. The heat-conduction portion 81 has high thermal conductivity and flexibility. That is, the heat-conduction portion 81 (graphite sheet) has a higher thermal conductivity than the thermal conductivity of the contact member 61 (aluminum), the thermal conductivity of the coupling portions 62 (resin), and the thermal conductivity of the holding units 63 (iron or stainless steel).

As the heat-conduction portion 81, not only a graphite sheet but also woven fabrics using carbon fibers (carbon fiber sheet) may be used. The allowable material for the heat-conduction portion 81 is a material having a higher thermal conductivity than the thermal conductivity of the coupling portion 62 (resin). Hence, in addition to the graphite sheet and the carbon fiber sheet mentioned above, a metal may be used for this purpose.

When the heat-conduction portion 81 is provided to be in contact with both the downstream side support unit 17 and the contact member 61, the thermal energy of the first heating unit 51 is conducted to the medium M via the downstream side support unit 17, the heat-conduction portion 81, and the contact member 61. Thus, the medium M is heated. In other words, the guide portion 60GA according to Exemplary Embodiment 8 includes the heat-conduction portion 81 configured to conduct, to the contact member 61, the thermal energy generated by the first heating unit 51.

The contact area CA of the medium M is an area of the medium M that is heated by the first heating unit 51. The downstream side support unit 17 is a heated-area support unit configured to support the contact area CA of the medium M. The heat-conduction portion 81 may be understood as a third coupling portion configured to couple the downstream side support unit 17 (heated-area support unit) with the contact member 61, that is, the heat-conduction portion 81 is an exemplar "third coupling portion". The printing apparatus 100G includes the downstream side support unit 17 configured to support the contact area CA of the medium M that is heated by the first heating unit 51. The "heat-conduction portion" in this application includes the third coupling portion (heat-conduction portion 81) configured to couple the downstream side support unit 17 with the contact member 61.

As such, the "heat-conduction portion" in this application includes a member (heat-conduction portion 81) that is different from the downstream side support unit 17.

In Exemplary Embodiment 5 and Exemplary Embodiment 6, the contact member 61 is heated by conducting the thermal energy of the second heating units 52 and 52A to the contact member 61. In Exemplary Embodiment 8, however, the contact member 61 is heated by conducting the thermal energy of the first heating unit 51 to the contact member 61 via the downstream side support unit 17 and the heat-conduction portion 81. Hence, in Exemplary Embodiment 8, the contact member 61 is heated without providing the second heating units 52 and 52A or the power source 53. Thus, effects such that the cost for providing the second heating units 52 and 52A and/or the power source 53 is saved and the structure is simplified are obtained.

In addition, in the printing apparatus 100G according to Exemplary Embodiment 8, the coupling portion 62 with a low thermal conductivity is disposed between each of the holding units 63 and the contact member 61. Hence, the temperature of the medium M heated by the first heating unit 51 via the downstream side support unit 17 is less likely to fall. Consequently, the high-temperature state of the medium M is maintained between the downstream side support unit 17 and the winding unit 40, and a state where the ink that landed on the medium M is dried more easily by the remaining heat is also maintained in the above-mentioned section. Accordingly, similar effects to the effects obtainable in Exemplary Embodiment 1 are obtained. Specifically, what is obtained is that the efficiency of the printing apparatus 100G is improved while the failures caused by the insufficient drying of the medium M are suppressed.

In addition, in the printing apparatus 100G according to Exemplary Embodiment 8, the thermal energy of the first heating unit 51 (the thermal energy of the downstream side support unit 17) is conducted to the contact member 61 via the downstream side support unit 17 and the heat-conduction portion 81. Thus, the temperature of the contact member 61 is raised. Hence, as compared to a configuration where the contact member 61 is not heated (i.e., the printing apparatus 100 of Exemplary Embodiment 1), the temperature of the medium M becomes higher between the downstream side support unit 17 and the winding unit 40, and the ink that landed on the medium M is dried quickly. In addition, the transport speed of the medium M is accelerated to further enhance the efficiency (throughput) of the printing apparatus 100G.

In another example according to Exemplary Embodiment 8, a heat-conduction portion 82 mounted on another guide portion 60GB may be separated into a plurality of members 82A, 82B, 82C, and 82D as illustrated in FIG. 18. The heat-conduction portion 82 (the plurality of members 82A, 82B, 82C, and 82D) is made from the same material as the material for the heat-conduction portion 81 (graphite sheet). Hence, the heat-conduction portion 82 has a high thermal conductivity and an excellent flexibility.

Also with such a configuration, the thermal energy of the first heating unit 51 is conducted to the contact member 61 via the downstream side support unit 17 and the heat-conduction portion 82. Thus, the temperature of the contact member 61 is raised. Hence, as compared to a configuration where the contact member 61 is not heated (i.e., the printing apparatus 100 of Exemplary Embodiment 1), the temperature of the medium M becomes higher between the downstream side support unit 17 and the winding unit 40, and the transport speed of the medium M is accelerated to enhance the efficiency (throughput) of the printing apparatus 100G.

The downstream side support unit 17, to which one of the heat-conduction portions 81 or 82 is attached is a member elongated in the scanning direction X and in a direction intersecting the scanning direction X. As compared to a member with short dimensions in the scanning direction X and in a direction intersecting the scanning direction X, the elongated member is more likely to be deformed by an external force applied, for example, when the downstream side support unit 17 is attached to the holding units 63. In addition, as the downstream side support unit 17 is attached to the holding units 63, the downstream side support unit 17 is likely to be deformed by, for example, a dimensional tolerance of the holding units 63.

In addition, the contact member 61 to which the other of the heat-conduction portions 81 or 82 is attached is also a member elongated in the scanning direction X, and is likely to be deformed by, for example, the dimensional tolerance.

For instance, when the deformation of the downstream side support unit 17 and the deformation of the contact member 61 are negligible and when the portion of the downstream side support unit 17, to which a first side of the heat-conduction portion 81 is attached, and the portion of the contact member 61, to which a second side of the heat-conduction portion 81 is attached, are substantially parallel to each other, as long as no excess stress is exerted on the heat-conduction portion 81, the heat-conduction portion 81 is properly attached to the downstream side support unit 17 and the contact member 61.

However, when the deformation of the downstream side support unit 17 and the deformation of the contact member 61 are not negligible and when the portion of the downstream side support unit 17, to which a first side of the heat-conduction portion 81 is attached, and the portion of the contact member 61, to which a second side of the heat-conduction portion 81 is attached, are skewed with respect to each other, the heat-conduction portion 81 is attached, in a skewed state, to the downstream side support unit 17 and the contact member 61. In addition, when the heat-conduction portion 81 is attached, in a skewed state, to the downstream side support unit 17 and the contact member 61, an unnecessary stress is exerted on the heat-conduction portion 81 and thus the heat-conduction portion 81 is more likely to be removed from the downstream side support unit 17 and the contact member 61.

As illustrated in FIG. 17, when the heat-conduction portion 81 has a shape elongated in the scanning direction X, the heat-conduction portion 81 that is deformed to follow the skew of the downstream side support unit 17 and/or the contact member 61 is attached to the downstream side support unit 17 and the contact member 61. Hence, an unnecessary stress is exerted on the heat-conduction portion 81, which makes stable attaching of the heat-conduction portion 81 to the downstream side support unit 17 and the contact member 61 difficult.

When the heat-conduction portion 82 includes the members 82A, 82B, 82C, and 82D each of which has a short dimension in the scanning direction X, and when the heat-conduction portion 82 (members 82A, 82B, 82C, and 82D) has a shape having a shorter dimension in the scanning direction X as illustrated in FIG. 18, as compared to a configuration where the heat-conduction portion 81 has a shape with a long dimension in the main scanning direction X (the configuration illustrated in FIG. 16), the skew of the heat-conduction portion 82 (members 82A, 82B, 82C, and 82D) is negligible and the stress exerted on the heat-conduction portion 82 is also negligible. Thus, the heat-conduction portion 82 can be stably attached to the downstream side support unit 17 and the contact member 61.

Accordingly, when the deformation of the downstream side support unit 17 and the deformation of the contact member 61 are not negligible and when the portion of the downstream side support unit 17, to which a first side of the heat-conduction portion 81 is attached, and the portion of the contact member 61, to which a second side of the heat-conduction portion 81 is attached, are skewed with respect to each other, the heat-conduction portion 82 may include members 82A, 82B, 82C, and 82D each of which has a short dimension in the scanning direction X.

Exemplary Embodiment 9

Figure 19:
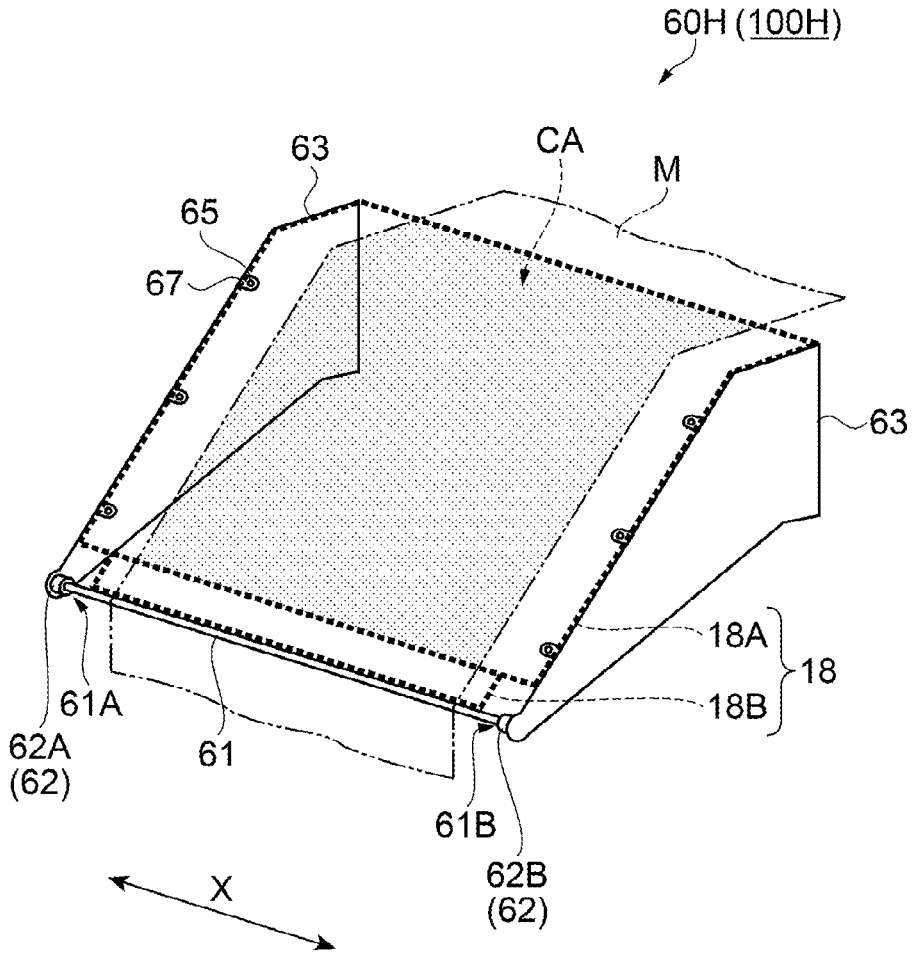
FIG. 19 is a perspective view of a guide portion mounted on a printing apparatus according to Exemplary Embodiment 9.

FIG. 19 is a diagram corresponding to FIG. 2, and is a perspective view of a guide portion mounted on a printing apparatus according to Exemplary Embodiment 9. In FIG. 19, a downstream side support unit 18 is represented by thick dashed lines.

A guide portion 60H according to Exemplary Embodiment 9 is identical to the guide portion 60 according to Exemplary Embodiment 1. The shape of the downstream side support unit 18 according to Exemplary Embodiment 9 differs from the corresponding shape in Exemplary Embodiment 1. This is a main difference between Exemplary Embodiment 9 and Exemplary Embodiment 1.

With reference to FIG. 19, an overview of a printing apparatus 100H according to Exemplary Embodiment 9 is described below by focusing on the differences from Exemplary Embodiment 1. Here, the components that are the same as the components in Exemplary Embodiment 1 are referenced using like numbers, and no descriptions for such components are provided below.

As illustrated in FIG. 19, in the printing apparatus 100H according to Exemplary Embodiment 9, the downstream side support unit 18 includes a main body unit 18A and a coupling portion 18B. The main body unit 18A has a shape that is identical to the shape of the downstream side support unit 17 according to Exemplary Embodiment 1, and has an identical configuration to the configuration of the downstream side support unit 17 according to Exemplary Embodiment 1. The coupling portion 18B is disposed on a side of the main body unit 18A closer to the contact member 61, and is in contact with the contact member 61. That is, the downstream side support unit 18 has a shape formed by elongating the downstream side support unit 17 according to Exemplary Embodiment 1, and makes the coupling portion 18B be in contact with the contact member 61.

As such, the downstream side support unit 18 includes the main body unit 18A having an identical shape to the shape of the downstream side support unit 17 according to Exemplary Embodiment 1 and the coupling portion 18B protruding from the main body unit 18A towards the contact member 61. By providing the coupling portion 18B, the downstream side support unit 18 is in contact with the contact member 61. In contrast, the downstream side support unit 17 according to Exemplary Embodiment 1 includes the gap 19 between the downstream side support unit 17 and the contact member 61, and thus is not in contact with the contact member 61 (see FIG. 2). These are the main differences between Exemplary Embodiment 9 and Exemplary Embodiment 1.

The coupling portion 18B is an exemplar "heat-conduction portion" and "third coupling portion".

In Exemplary Embodiment 9, the main body unit 18A of the downstream side support unit 18 corresponds to the "heated-area support unit configured to support the heated area, which is an area of the medium that is heated by the first heating unit". The coupling portion 18B of the downstream side support unit 18 corresponds to the "third coupling portion configured to couple the heated-area support unit with the contact member". In other words, the printing apparatus 100H includes the main body unit 18A (heated-area support unit) of the downstream side support unit 18 configured to support the contact area CA, which is the area of the medium M that is heated by the first heating unit 51. The "heat-conduction portion" in this application includes the coupling portion 18B of the downstream side support unit 18 configured to couple the main body unit 18A of the downstream side support unit 18 with the contact member 61.

As such, the "heat-conduction portion" in this application includes a member (coupling portion 18B) that is identical to the downstream side support unit 17.

The thermal energy of the first heating unit 51 is conducted to the contact member 61 by the main body unit 18A of the downstream side support unit 18 and the coupling portion 18B of the downstream side support unit 18, and thus raises the temperature of the contact member 61, and also raises the temperature of the medium M, which is in contact with the contact member 61. The thermal energy of the first heating unit 51 is conducted to the contact member 61 via the main body unit 18A and the coupling portion 18B, and thus raises the temperature of the contact member 61. Hence, as compared to a configuration where the contact member 61 is not heated (i.e., the printing apparatus 100 of Exemplary Embodiment 1), the temperature of the medium M becomes higher between the downstream side support unit 17 and the winding unit 40, and the ink that landed on the medium M is dried quickly. In addition, the transport speed of the medium M is accelerated to further enhance the efficiency (throughput) of the printing apparatus 100H.

In Exemplary Embodiment 8, a member that is different from the downstream side support unit 17 (i.e., the heat-conduction portion 81 or 82 (see FIGS. 16 and 18)) is disposed between the downstream side support unit 17 and the contact member 61. Thus the "heat-conduction portion" configured to couple the downstream side support unit 17 with the contact member 61 is formed by the member that is different from the downstream side support unit 17 (i.e., heat-conduction portion 81, 82). In Exemplary Embodiment 9, the "heat-conduction portion" configured to couple the main body unit 18A of the downstream side support unit 17 with the contact member 61 is formed by extending the downstream side support unit 17 towards the contact member 61 and by using the same member (coupling portion 18B) as the material used for the downstream side support unit 17.

As such, the third coupling portion configured to couple the heated-area support unit (downstream side support unit 17 and the main body unit 18A of the downstream side support unit 18) with the contact member (contact member 61), that is, the "heat-conduction portion" in this application, may be a separate member disposed between the downstream side support unit 17 and the contact member 61 (e.g., heat-conduction portion 81 or 82), or may be a part of the downstream side support unit 18 (e.g., the coupling portion 18B of the downstream side support unit 18) that is formed by extending the downstream side support unit 18.

When the third coupling portion is a part of the heated-area support unit formed by extending the heated-area support unit, as compared to a case where a member that is different from the heated-area support unit (i.e., a separate member) is used as the third coupling portion, a new member that is different from the heated-area support unit is not needed, and consequently, the "heat-conduction portion (third coupling portion)" is made at a lower cost.

In addition, the heat-conduction portion configured to conduct to the contact member 61 the heat of the main body unit 18A of the downstream side support unit 18 may be a heat pipe. For instance, when the heat source (e.g., the first heating unit 51 and second heating unit 52) is disposed at a different location from the location in Exemplary Embodiment 8 and Exemplary Embodiment 9 (the downstream side support unit 18 and the contact member 61) and when the route over which the thermal energy of the heat source is conducted is curved, use of a heat pipe as the heat-conduction portion allows the thermal energy of the heat source to be conducted efficiently to the contact member 61 via the heat pipe because the heat pipe is processable into various shapes.

In addition, in Exemplary Embodiment 8, the third coupling portion (heat-conduction portion 81 or 82) configured to couple the heated-area support unit (downstream side support unit 17) with the contact member (contact member 61) is provided as the heat-conduction portion configured to conduct to the contact member 61 the thermal energy generated by the first heating unit 51. The third coupling portion (heat-conduction portion 81 or 82) is indirectly coupled with the first heating unit 51 via the downstream side support unit 17. The configuration for coupling the third coupling portion with the first heating portion is not limited to a configuration where third coupling portion (heat-conduction portion 81 or 82) is indirectly coupled with the first heating unit 51 via the downstream side support unit 17. Instead, a configuration where the third coupling portion (heat-conduction portion 81 or 82) is directly coupled with the first heating unit 51 may also be employed for the same purpose. That is, the heat-conduction portion 81 or 82 may be provided to couple the first heating unit 51 with the contact member 61.

In addition, an allowable configuration is a configuration including a portion where the third coupling portion (heat-conduction portion 81 or 82) is indirectly coupled with the first heating unit 51 and a portion where the third coupling portion (heat-conduction portion 81 or 82) is coupled directly with the first heating unit 51.

In Exemplary Embodiment 8 and Exemplary Embodiment 9, the coupling portion 62 with a low thermal conductivity is disposed between the contact member 61 and the holding unit 63, which makes the configuration less likely to allow the heat of the contact member 61 to be conducted to the side of the holding units 63. In addition, the configuration in Exemplary Embodiment 8 and Exemplary Embodiment 9 allows the thermal energy of the first heating unit 51 to be conducted to the contact member 61 via the heat-conduction portion (the heat-conduction portion 81 or 82, and the coupling portion 18B of the downstream side support unit 18) and thus raise the temperature of the contact member 61 up to the target temperature.

With the configuration where the heat of the contact member 61 is less likely to be conducted to the holding unit 63 (a configuration with the coupling portions 62), even when the thermal energy (power consumption) of the first heating unit 51 is reduced from the case of a configuration where the heat of the contact member 61 is more likely to be conducted to the holding unit 63 (a configuration with no coupling portion 62), the temperature of the contact member 61 is raised up to a target temperature and thus the energy saving is achieved.

In addition, as the heat of the contact member 61 is less likely to be conducted to the holding units 63, the difference in the temperature of the contact member 61 between the sides in the contact member 61 near the holding units 63 and the sides in the contact member 61 far from the holding units 63 becomes smaller, resulting in a more uniform temperature distribution in the contact member 61. Hence, in Exemplary Embodiment 8 and Exemplary Embodiment 9, the temperature uniformity across the contact member 61 is enhanced and thus the temperature uniformity across the medium M heated by the contact member 61 is also enhanced. Thus, an effect such that the ink that landed on the medium M is dried quickly and an effect such that the ink that landed on the medium M is more likely to be dried uniformly are obtained.

Even with a configuration where the coupling portion 62 having a low thermal conductivity is not provided between the contact member 61 and the corresponding holding unit 63 and where the heat-conduction portion (heat-conduction portion 81 or 82, and the coupling portion 18B of the downstream side support unit 18) configured to conduct the thermal energy of the first heating unit 51 to the contact member 61 is provided, the thermal energy of the first heating unit 51 is conducted to the medium M via the heat-conduction portion (the heat-conduction portion 81 or 82, and the coupling portion 18B of the downstream side support unit 18) and the contact member 61, the temperature of the medium M is raised, and the ink that landed on the medium M is dried properly. Thus, the failures caused by the insufficiently dried medium M (sticking of the medium M in the winding-side roll body 41, bleeding of images, blurring of images, and the like) are suppressed, and some challenges set for this application are addressed properly.

Accordingly, a configuration may be employed where the coupling portion 62 having a low thermal conductivity is not provided between the contact member 61 and the corresponding holding unit 63 and where the heat-conduction portion (the heat-conduction portion 81 or 82, and the coupling portion 18B of the downstream side support unit 18) configured to conduct the thermal energy of the first heating unit 51 to the contact member 61 is provided.

Exemplary Embodiment 10

Figure 20:
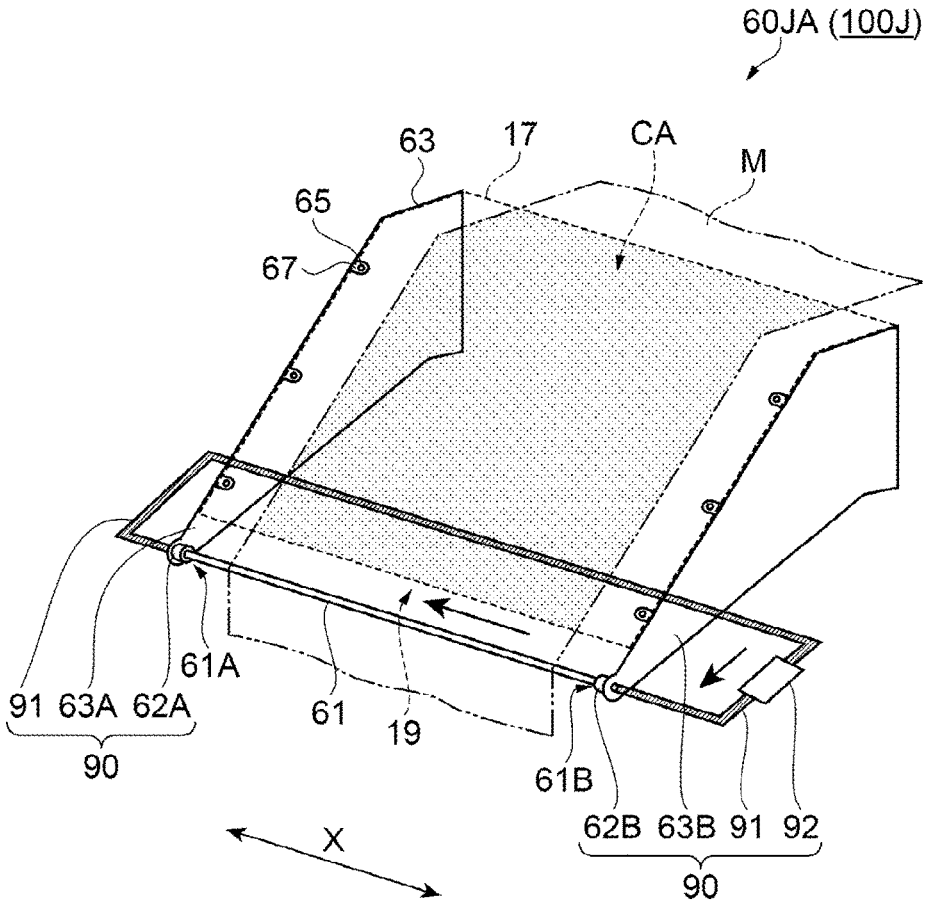
FIG. 20 is a perspective view of a guide portion mounted on a printing apparatus according to Exemplary Embodiment 10.
Figure 21:
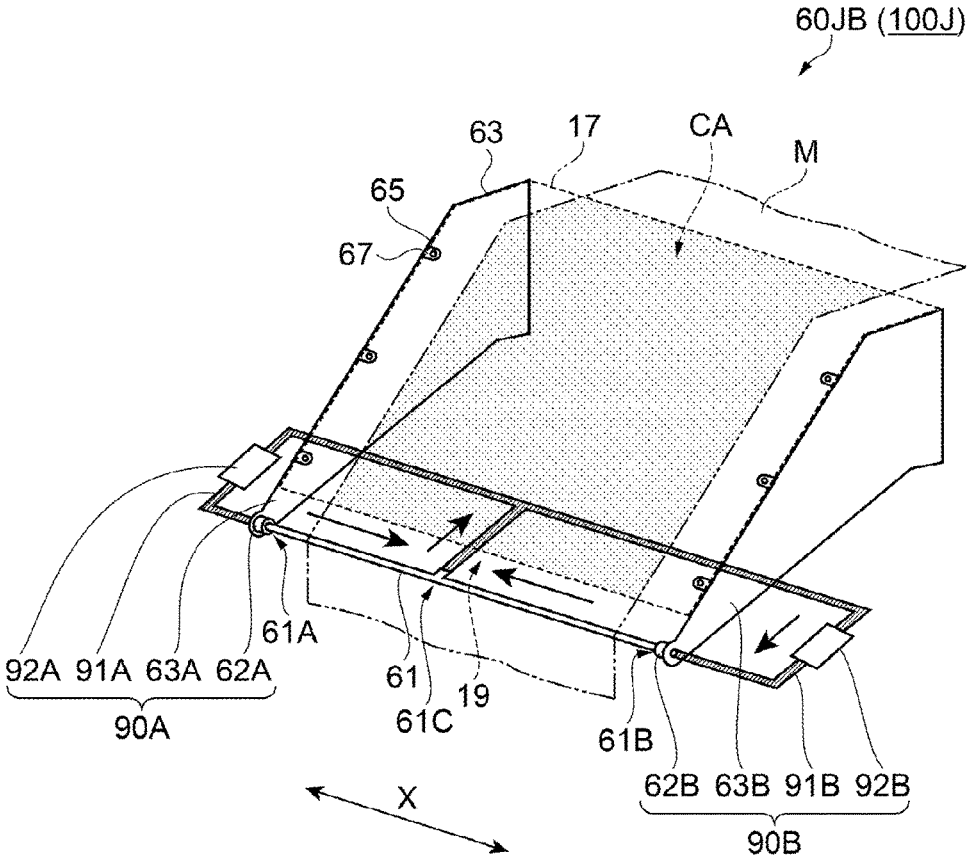
FIG. 21 is a perspective view of another guide portion mounted on a printing apparatus according to Exemplary Embodiment 10.

FIG. 20 is a diagram corresponding to FIG. 2, and is a perspective view of a guide portion mounted on a printing apparatus according to Exemplary Embodiment 10. FIG. 21 is a diagram corresponding to FIG. 2, and is a perspective view of another guide portion mounted on the printing apparatus according to Exemplary Embodiment 10.

A guide portion 60JA or 60JB according to Exemplary Embodiment 10 includes a circulation unit 90, or circulation units 90A and 90B configured to circulate a gas (an exemplar "fluid body") between the first heating unit 51 and the contact member 61. This is a main difference between Exemplary Embodiment 10 and Exemplary Embodiment 1.

With reference to FIG. 20 and FIG. 21, an overview of a printing apparatus 100J according to Exemplary Embodiment 10 is described below by focusing on the differences from Exemplary Embodiment 1. Here, the components that are the same as the components in Exemplary Embodiment 1 are referenced using like numbers, and no descriptions for such components are provided below.

As illustrated in FIG. 20, the contact member 61 included in the guide portion 60JA mounted on the printing apparatus 100J according to Exemplary Embodiment 10 is a hollow pipe elongated in the scanning direction X with a cavity inside of the contact member 61. The cavity of the contact member 61 serves as a passage for gas flow. A holding unit 63A situated on a first side in the scanning direction X, a first coupling portion 62A, and an end portion 61A situated on a first side of the contact member 61 are fixedly coupled with one another, and through-holes (not illustrated) are formed in the fixedly coupling portions allowing the gas to flow through the through-holes. A holding unit 63B situated on a second side in the scanning direction X, a second coupling portion 62B, and an end portion 61B situated on a second side of the contact member 61 are fixedly coupled with one another, and through-holes (not illustrated) are formed in the fixedly coupling portions allowing the gas to flow through the through-holes.

In addition, a duct 91 is provided to couple the holding unit 63A on the first side in the scanning direction X with a through-hole formed to allow the gas to flow through the through-hole to the holding unit 63B on the second side in the scanning direction X with a through-hole formed to allow the gas to flow through the through-hole. The duct 91 includes a first end coupled to the through-hole of the holding unit 63A and a second end coupled to the through-hole of the holding unit 63A, and a section between the first end and the second end is fixed to a backside of the downstream side support unit 17. Inside of the duct 91, there is a cavity that serves as a passage through which the gas flows.

At least the section of the duct 91 that is fixed to the downstream side support unit 17 (the section that is positioned on the backside of the downstream side support unit 17) is made, for instance, from aluminum, and has a thermal conductivity that is higher than the thermal conductivity of the contact member 61. The duct 91 is disposed to transverse the downstream side support unit 17 in the scanning direction X, and is fixed, with aluminum tape or the like, to a surface of the downstream side support unit 17 to which the first heating unit 51 is attached. In addition, an air blowing fan 92 is provided between the section of the duct 91 that is coupled to the through-hole of the holding unit 63B and the section of the duct 91 that is fixed to the downstream side support unit 17.

The circulation unit 90 (passage for the gas) through which the gas flows is formed with the through-hole formed in the holding unit 63B on the second side, the second coupling portion 62B, and the end portion 61B on the second side of the contact member 61, the duct 91, the air blowing fan 92, and the through-hole formed in the holding unit 63A on the first side, the first coupling portion 62A, and the end portion 61A on the first side of the contact member 61.

In addition, as the contact member 61 also forms a part of the passage through which the gas flows, the contact member 61 and the circulation unit 90 together form an annular passage for the gas. Once the air blowing fan 92 is started, the gas circulates within the annular gas passage formed by the circulation unit 90 and the contact member 61. As illustrated by an arrow in the drawing, the gas flows within the contact member 61 from the end portion 61B on the second side of the contact member 61 to the end portion 61A on the first side of the contact member 61.

As such the guide portion 60JA according to Exemplary Embodiment 10 not only includes the contact member 61, the coupling portion 62, and the holding units 63A and 63B but also further includes the circulation unit 90. Once the air blowing fan 92 is started, the gas flows within the contact member 61 from the end portion 61B on the second side of the contact member 61 to the end portion 61A on the first side of the contact member 61.

In the circulation unit 90, the section of the duct 91 that is fixed to the downstream side support unit 17 is heated and thus the gas inside the duct 91 is also heated. That is, the thermal energy of the first heating unit 51 is conducted to the gas in the duct 91 via the downstream side support unit 17 and the duct 91, and the gas in the duct 91 is thus heated. In addition, once the air blowing fan 92 is started, heated gas flows within the contact member 61 from the end portion 61B on the second side of the contact member 61 to the end portion 61A on the first side of the contact member 61, and thus the contact member 61 is heated. That is, once the air blowing fan 92 is started, and the gas heated in the section of the downstream side support unit 17 to which the duct 91 is fixed is made to flow within the annular gas passage formed by the circulation unit 90 and the contact member 61, the thermal energy of the first heating unit 51 is conducted, by the circulation unit 90, to the contact member 61 and thus the contact member 61 is heated.

As such, the circulation unit 90 serves as a "heat-conduction portion" configured to allow the heated gas to flow through and thus conduct the thermal energy of the first heating unit 51 to the contact member 61. That is, the printing apparatus 100J according to Exemplary Embodiment 10 includes the circulation unit 90 configured to circulate the gas between the first heating unit 51 and the contact member 61, and the circulation unit 90 serves as the "heat-conduction portion" configured to conduct the thermal energy of the first heating unit 51 to the contact member 61. In other words, the "heat-conduction portion" in this application includes the circulation unit 90 configured to circulate the gas between the first heating unit 51 and the contact member 61.

In the printing apparatus 100J according to Exemplary Embodiment 10, the coupling portions 62A and 62B with a low thermal conductivity are disposed between the contact member 61 and the holding unit 63A and 63B, respectively. Hence, the temperature of the medium M heated by the first heating unit 51 via the downstream side support unit 17 is less likely to fall. Consequently, the high-temperature state of the medium M is maintained between the downstream side support unit 17 and the winding unit 40, and a state where the ink that landed on the medium M is dried more easily by the remaining heat is also maintained in the above-mentioned section. Accordingly, similar effects to the effects obtainable in Exemplary Embodiment 1 are obtained. Specifically, what is obtained is that the efficiency of the printing apparatus 100J is improved while the failures caused by the insufficient drying of the medium M are suppressed.

In addition, in the printing apparatus 100J according to Exemplary Embodiment 10, the circulation unit 90 serves as the "heat-conduction portion" configured to conduct the thermal energy of the first heating unit 51 to the contact member 61, the thermal energy of the first heating unit 51 is conducted to the contact member 61 by the circulation unit 90, and thus the temperature of the contact member 61 is raised. Consequently, as compared to the configuration where the contact member 61 is not heated by the circulation unit 90 (e.g., the printing apparatus 100 of Exemplary Embodiment 1), the temperature of the medium M is raised further while the medium M is between the downstream side support unit 17 and the winding unit 40. The ink that landed on the medium M is thus dried quickly, and the transport speed of the medium M is accelerated to further enhance the efficiency (throughput) of the printing apparatus 100J.

As another example according to Exemplary Embodiment 10, a branching portion 61C configured to branch the gas passage is provided at the center of the contact member 61 included in the guide portion 60JB, as illustrated in FIG. 21.

Provided in the guide portion 60JB is a duct 91A configured to couple a portion where the holding unit 63A on the first side in the scanning direction X, the first coupling portion 62A, and the end portion 61A on the first side of the contact member 61 are coupled with one another to the branching portion 61C of the contact member 61. An air blowing fan 92A is disposed on a first side of the duct 91A that is near the holding unit 63A. A first circulation unit 90A is formed with the duct 91A, the air blowing fan 92A, and the portion where the holding unit 63A on the first side in the scanning direction X, the first coupling portion 62A, and the end portion 61A on the first side of the contact member 61 are coupled to one another.

The first circulation unit 90A is fixedly coupled to the branching portion 61C of the contact member 61, and the annular gas passage is formed with the first circulation unit 90A and the contact member 61. Once the air blowing fan 92A is started, the gas flows within the contact member 61 from the end portion 61A on the first side of the contact member 61 to the branching portion 61C as illustrated by the arrow in the drawing.

Provided in the guide portion 60JB is a duct 91B configured to fixedly couple a portion where the holding unit 63B on the second side in the scanning direction X, the second coupling portion 62B, and the end portion 61B on the second side of the contact member 61 are coupled with one another to the branching portion 61C of the contact member 61. An air blowing fan 92B is disposed on a second side of the duct 91B that is near the holding unit 63B. A second circulation unit 90B is formed with the duct 91B, the air blowing fan 92B, and the portion where the holding unit 63B on the second side in the scanning direction X, the second coupling portion 62B, and the end portion 61B on the second side of the contact member 61 are fixedly coupled to one another.

The second circulation unit 90B is fixedly coupled to the branching portion 61C of the contact member 61, and the annular gas passage is formed with the second circulation unit 90B and the contact member 61. Once the air blowing fan 92B is started, the gas flows within the contact member 61 from the end portion 61B on the second side of the contact member 61 to the branching portion 61C as illustrated by the arrow in the drawing.

The annular gas passage formed with the first circulation unit 90A and the contact member 61 partly overlaps the annular gas passage formed with the second circulation unit 90B and the contact member 61, at the branching portion 61C of the contact member 61. The gas that flows within the contact member 61 from the end portion 61A on the first side of the contact member 61 to the branching portion 61C joins, at the branching portion 61C, the gas that flows within the contact member 61 from the end portion 61B on the second side of the contact member 61 to the branching portion 61C.

As such, the guide portion 60JB according to Exemplary Embodiment 10 further includes the two circulation units 90A and 90B in addition to the contact member 61, the coupling portions 62, and the holding units 63A and 63B. Once the air blowing fans 92A and 92B are started, the gas flows within the contact member 61 both in the direction from the end portion 61A on the first side of the contact member 61 to the branching portion 61C and in the direction from the end portion 61B on the second side of the contact member 61 to the branching portion 61C.

As illustrated in FIG. 20, the guide portion 60JA includes the single circulation unit 90. The heated gas flows from the end portion 61B on the second side of the contact member 61 to the end portion 61A on the first side of the contact member 61, and thus the contact member 61 is heated. In addition, as illustrated in FIG. 21, the guide portion 60JB includes the two circulation units 90A and 90B. The heated gas flows from the end portion 61A on the first side of the contact member 61 to the branching portion 61C, and the heated gas also flows from the end portion 61B on the second side of the contact member 61 to the branching portion 61C. Thus, the contact member 61 is heated. Consequently, the length of the gas passage of the guide portion 60JA including the single circulation unit 90 is longer than the length of the gas passage of the guide portion 60JB including the two circulation units 90A and 90B. The length of the gas passage in the contact member 61 of the guide portion 60JB including the two circulation units 90A and 90B is shorter than the length of the gas passage in the contact member of the guide portion 60JA including the single circulation unit 90.

The gas is cooled in the process in which the gas is flowing within the contact member 61. Hence, a longer gas passage renders a greater temperature difference between a gas inlet side (at the end portion 61B on the second side) and a gas outlet side (at the end portion 61A on the first side) than a shorter gas passage, which makes the heating of the contact member 61 less uniform. The shorter gas passage renders a smaller temperature difference between the gas inlet side (at the end portions 61A and 61B) and the gas outlet side (at the branching portion 61C) than the longer gas passage, which makes the heating of the contact member 61 more uniform.

Accordingly, as compared with the guide portion 60JA including the single circulation unit 90, the guide portion 60JB including the two circulation units 90A and 90B enhances the temperature uniformity across a heated contact member 61. As such, the guide portion 60JB enhances the temperature uniformity across the contact member 61 as compared with the guide portion 60JA, and the temperature uniformity across the medium M heated by the contact member 61 is also enhanced by the use of the guide portion 60JB. Thus, an effect such that the ink that landed on the medium M is dried quickly and an effect such that the ink that landed on the medium M is more likely to be dried uniformly are obtained.

In addition, the temperature uniformity across the heated contact member 61 is enhanced by employing two passages for the gas that flows within the contact member 61, as well. To be more specific, the temperature uniformity across the contact member 61 is also enhanced by forming two cavities within the contact member 61, making the gas flow through one of the two cavities from the end portion 61A on the first side to the end portion 61B on the second side, and making the gas flow through the other one of the two cavities from the end portion 61B on the second side to the end portion 61A on the first side.

In addition, in Exemplary Embodiment 10, the contact member 61 is heated by using, as the gas passage, the cavity formed within the contact member 61. The configuration for heating the contact member 61 is not limited to the configuration where the cavity formed within the contact member 61 is used as the gas passage, but a configuration where a gas passage is formed outside of the contact member 61 and the outside passage is used for heating the contact member 61 may be used instead.

In addition, a configuration where a heating unit is provided in the circulation unit 90 and a gas heated by the heating unit flows within the circulation unit 90, or the circulation units 90A and 90B to heat the contact member 61 may be used, as well.

In addition, the fluid flowing within the circulation unit 90, or the circulation units 90A and 90B is not limited to a gas, but may instead be, for instance, a liquid.

In Exemplary Embodiment 10, the coupling portions 62 with a low thermal conductivity are disposed between the contact member 61 and the corresponding holding units 63A and 63B, which makes the configuration less likely to allow the heat of the contact member 61 to be conducted to the holding units 63. In addition, the configuration in Exemplary Embodiment 10 allows the thermal energy of the first heating unit 51 to be conducted to the contact member 61 via the heat-conduction portion (the circulation unit 90, or the circulation units 90A and 90B) and thus raise the temperature of the contact member 61 up to the target temperature.

With the configuration where the heat of the contact member 61 is less likely to be conducted to the holding units 63A and 63B (a configuration with the coupling portions 62), even when the thermal energy (power consumption) of the first heating unit 51 is reduced from the case of a configuration where the heat of the contact member 61 is more likely to be conducted to the holding units 63A and 63B (a configuration with no coupling portion 62), the temperature of the contact member 61 is raised up to a target temperature and thus energy saving is achieved.

In addition, as the heat of the contact member 61 is less likely to be conducted to the holding units 63A and 63B, the temperature difference within the contact member 61 between the sides near the holding units 63A and 63B and the sides far from the holding units 63A and 63B becomes smaller, resulting in a more uniform temperature distribution in the contact member 61. Hence in Exemplary Embodiment 10, the temperature uniformity across the contact member 61 is enhanced and thus the temperature uniformity across the medium M heated by the contact member 61 is also enhanced. Thus, an effect such that the ink that landed on the medium M is dried quickly and an effect such that the ink that landed on the medium M is more likely to be dried uniformly are obtained.

Even with a configuration where the coupling portion 62 having a low thermal conductivity is not provided between the contact member 61 and the corresponding holding unit 63 and where the heat-conduction portion (the circulation unit 90, or circulation units 90A and 90B) configured to conduct the thermal energy of the first heating unit 51 to the contact member 61 is provided, the thermal energy of the first heating unit 51 is conducted to the medium M via the heat-conduction portion (the circulation unit 90, or circulation units 90A and 90B) and the contact member 61, the temperature of the medium M is raised, and the ink that landed on the medium M is dried properly. Thus, the failures caused by the insufficiently dried medium M (sticking of the medium M in the winding-side roll body 41, bleeding of images, blurring of images, and the like) are suppressed, and some challenges set for this application are addressed properly.

Accordingly, a configuration may be employed where the coupling portion 62 having a low thermal conductivity is not provided between the contact member 61 and the corresponding holding unit 63 and where the heat-conduction portion (the circulation unit 90, or circulation units 90A and 90B) configured to conduct the thermal energy of the first heating unit 51 to the contact member 61 is provided.

In addition, for instance, by combining the configuration of Exemplary Embodiment 8 with the configuration of Exemplary Embodiment 10, the guide portion may include both the heat-conduction portion 82 and the circulation unit 90.

What is claimed is:

1. A printing apparatus comprising:

a printing unit configured to perform printing on a medium that is transported in a transport direction;

a guide portion disposed on a downstream side of the printing unit in the transport direction and configured to guide the medium; and a first heating unit disposed between the printing unit and the guide portion in the transport direction and configured to heat the medium, wherein the guide portion includes a contact member configured to guide the medium by contacting the medium, a coupling portion coupled to the contact member, and a holding unit disposed at one end of the contact member in a width direction and configured to hold the contact member via the coupling portion, the width direction being a direction perpendicular to the transport direction, and thermal conductivity of the coupling portion is lower than thermal conductivity of the holding unit.

2. The printing apparatus according to claim 1, wherein the coupling portion includes:

a first coupling portion coupled to an end portion on a first side of the contact member in a longitudinal direction of the contact member; and a second coupling portion coupled to an end portion on a second side of the contact member in the longitudinal direction of the contact member.

3. The printing apparatus according to claim 1, wherein the coupling portion is provided passing through the contact member from an end portion on a first side of the contact member in a longitudinal direction of the contact member to an end portion on a second side of the contact member in the longitudinal direction of the contact member.

4. The printing apparatus according to claim 1, wherein the guide portion includes a second heating unit configured to heat the contact member.

5. The printing apparatus according to claim 4, wherein the second heating unit is disposed at least inside of the contact member.

6. The printing apparatus according to claim 4, wherein the contact member includes:

a contact area in contact with the medium when the contact member guides the medium; and a non-contact area not in contact with the medium when the contact member guides the medium, and the second heating unit is disposed at least in the non-contact area.

7. The printing apparatus according to claim 4, wherein the contact member includes:

a contact area in contact with the medium when the contact member guides the medium; and a non-contact area not in contact with the medium when the contact member guides the medium, wherein a low-thermal-conductivity member having thermal conductivity that is lower than thermal conductivity of the contact member is attached to the non-contact area.

8. The printing apparatus according to claim 1, wherein the guide portion includes a heat-conduction portion configured to conduct thermal energy generated by the first heating unit to the contact member.

9. The printing apparatus according to claim 8, further comprising:

a heated-area support unit configured to support a heated area, which is an area of the medium that is heated by the first heating unit, wherein the heat-conduction portion includes a third coupling portion configured to couple the heated-area support unit to the contact member.

10. The printing apparatus according to claim 8, wherein the heat-conduction portion includes a circulation unit configured to circulate a fluid between the first heating unit and the contact member.

* * * * *